US010847097B2

(12) United States Patent
Park

(10) Patent No.: US 10,847,097 B2
(45) Date of Patent: Nov. 24, 2020

(54) DISPLAY DEVICE

(71) Applicant: LG Display Co., Ltd., Seoul (KR)

(72) Inventor: Dongwon Park, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/533,013

(22) Filed: Aug. 6, 2019

(65) Prior Publication Data

US 2020/0111422 A1 Apr. 9, 2020

(30) Foreign Application Priority Data

Oct. 8, 2018 (KR) ..... 10-2018-0119829

(51) Int. Cl.
*G09G 3/3291* (2016.01)
*G09G 3/20* (2006.01)
*G09G 3/3258* (2016.01)

(52) U.S. Cl.
CPC ..... *G09G 3/3291* (2013.01); *G09G 3/2092* (2013.01); *G09G 3/3258* (2013.01)

(58) Field of Classification Search
CPC ... G09G 3/3291; G09G 3/2092; G09G 3/3258
USPC ..... 345/76, 204, 208; 315/169.3
See application file for complete search history.

(56) References Cited

U.S. PATENT DOCUMENTS 7,245,277 B2 * 7/2007 Ishizuka ..... G09G 3/3233 315/169.3
9,305,477 B2 4/2016 Senda et al.
10,281,719 B2 5/2019 Lee et al.
2007/0222718 A1 * 9/2007 Takahara ..... G09G 3/2011 345/76
2009/0153446 A1 * 6/2009 Senda ..... G09G 3/3283 345/76
2011/0273408 A1 * 11/2011 Ra ..... G09G 3/3266 345/204
2012/0139820 A1 6/2012 Senda et al.
(Continued)

FOREIGN PATENT DOCUMENTS

JP 2010-107582 A 5/2010
JP 2012-118492 A 6/2012
(Continued)

OTHER PUBLICATIONS

Japan Patent Office, Notice of Reasons for Refusal, JP Patent Application No. 2019-175403, dated Sep. 8, 2020, 14 pages.

*Primary Examiner* — Prabodh M Dharia
(74) *Attorney, Agent, or Firm* — Fenwick & West LLP

(57) ABSTRACT

The display device according to the present disclosure may comprise a display panel including data lines and scan lines crossing each other and pixels disposed in a plurality of horizontal lines; a data driving circuit configured to supply data voltages to the data lines; a gate driving circuit configured to supply scan signals for applying the data voltages to the pixels and to supply reset signals for turning off the pixels that are emitting light to the pixels through the scan lines; and a timing controller configured to cause first pixels in a first area to simultaneously emit light and simultaneously stop emitting light, and cause second pixels in a second area different than the first area to sequentially emit light and sequentially stop emitting light by controlling the data driving circuit and the gate driving circuit.

18 Claims, 19 Drawing Sheets

(56) References Cited

U.S. PATENT DOCUMENTS

| | | | | |
|---|---|---|---|---|
| 2014/0320469 | A1* | 10/2014 | Han | G09G 3/3233 345/208 |
| 2016/0111057 | A1* | 4/2016 | Choi | G09G 3/3666 345/204 |
| 2017/0108970 | A1* | 4/2017 | Kim | G06F 3/0412 |
| 2018/0089491 | A1* | 3/2018 | Kim | G06F 3/0412 |
| 2018/0095274 | A1 | 4/2018 | Lee et al. | |
| 2018/0136511 | A1* | 5/2018 | Kudo | G02F 1/133512 |
| 2018/0158396 | A1* | 6/2018 | Lee | G09G 3/2092 |
| 2018/0249150 | A1* | 8/2018 | Takeda | G02B 27/0172 |
| 2018/0261161 | A1* | 9/2018 | Ota | H01L 51/5221 |
| 2018/0307044 | A1* | 10/2018 | Oh | G02B 27/0176 |
| 2019/0164484 | A1* | 5/2019 | Yeo | G09G 3/3291 |

FOREIGN PATENT DOCUMENTS

| | | | |
|---|---|---|---|
| JP | 2016-170385 | A | 9/2016 |
| KR | 10-2017-0077921 | A | 7/2017 |
| KR | 10-2018-0036429 | A | 4/2018 |
| WO | WO 2010/082479 | A1 | 7/2010 |

* cited by examiner

①①' Ping-pong Addressing (FOV Area)
②②' Ping-pong Addressing (Non-FOV Area)

① Progressive Addressing (FOV Area)
②②' Ping-pong Addressing (Non-FOV Area)

Deficient luminance is compensated by adjusting data

DISPLAY DEVICE

This application claims priority to Republic of Korea Patent Application No. 10-2018-0119829, filed on Oct. 8, 2018, which is incorporated herein by reference in its entirety.

BACKGROUND

Field of the Disclosure

The present disclosure relates to a display device, and more particularly, to a display device applicable to a virtual reality device.

Discussion of the Related Art

Virtual reality technology is rapidly evolving in the fields of multimedia, games, movies, architecture, tourism, and defense. Virtual reality refers to a specific environment or situation that users feel similar to a real environment by using stereoscopic image technology. A device for realizing the virtual reality technology may be divided into a virtual reality (VR) device or an augmented reality (AR) device. These devices are being developed as various types of display devices such as a head mounted display (HMD), a face mounted display (FMD), and an eye glasses-type display (EGD).

In order to immerse a user in the VR display device, the image is enlarged through a lens and provided at a position very close to user's eyes. Thus, the size of the display device is small, but an ultra-high resolution display panel having a very high pixel per inch (PPI) is used so that the user can not recognize the pixels.

An active matrix type organic light emitting display panel including an organic light emitting diode (hereinafter, referred to as "OLED") which emits light by itself has advantages of a fast response speed, high light emitting efficiency, high brightness, and a wide viewing angle. Thus, organic light emitting display panels are used in an increasing number of VR displays.

The VR display device employing the organic light emitting display panel is driven to emit light for a short time in a global shutter method or a rolling shutter method. The VR display device may increase a resolution and a frame rate in order to increase realism and immersion. Since the addressing time and the horizontal period for data writing are shortened, the time margin for charging the pixel with a data voltage is shortened, and a light emission duration is also shortened, the luminance of the display screen is lowered.

When the luminance of the display screen is low, user's immersion degree is low. Therefore, it is important to raise the luminance of the VR display device in order to improve user's satisfaction with the user experience. However, there is a limitation in increasing the light emission duration for raising the luminance of the display screen in a conventional uniform scan method, that is, a conventional data writing and light emitting method.

SUMMARY

The present disclosure has been made in view of the above circumstances. It is an object of the present disclosure to improve the display performance of a VR display device employing an organic light emitting display panel.

It is another object of the present disclosure to provide a driving method for increasing luminance and reducing user's fatigue in a VR display device.

A display panel according to an embodiment of the present disclosure may comprise: a display panel including data lines and scan lines crossing each other and pixels disposed in a plurality of horizontal lines; a data driving circuit configured to supply data voltages to the data lines; a gate driving circuit configured to supply scan signals for applying the data voltages to the pixels and to supply reset signals for turning off the pixels that are emitting light to the pixels through the scan lines; and a timing controller configured to simultaneously turn on the first pixels in the first area to emit light and simultaneously turn off the first pixels and to sequentially turn on and sequentially turn off second pixels in a second area different than the first area by controlling the data driving circuit and the gate driving circuit.

In an embodiment, the timing controller is configured to simultaneously turn on the first pixels after applying the data voltages to all the first pixels, and to sequentially turn off the second pixels while sequentially applying the data voltages to the second pixels.

In an embodiment, the timing controller is configured to simultaneously turn off the first pixels after an emission duration elapses since the first pixels are simultaneously turned on, and to sequentially turn off the second pixels after the emission duration elapses since the second pixels are sequentially turned on in a unit of the plurality of horizontal lines.

In an embodiment, when the first area is disposed at a center of the display panel with respect to a first direction in which the data lines travel, wherein the second area is divided into third and fourth areas on upper and lower sides, respectively, of the first area with respect to the first direction, the timing controller is configured to alternately perform a first scan operation in the third area and a second scan operation in the fourth area at an interval of one horizontal period in a ping-pong addressing manner.

In an embodiment, the timing controller is configured to alternately perform an upward scan operation and a downward scan operation at the interval of one horizontal period in the ping-pong addressing manner, the upward scan operation proceeding from a center of the first area toward the third area with respect to the first direction, the downward scan operation proceeding from the center of the first area toward the fourth area with respect to the first direction. Or the timing controller is configured to perform a scan operation from a first boundary of the first area toward a second boundary of the first area with respect to the first direction in a sequential addressing manner.

In an embodiment, the first area is disposed at a center of the display panel with respect to a first direction in which the data lines travel, and the second area is divided into a third area and a fourth area on one side and an opposite side, respectively, of the first area with respect to the first direction, and wherein the timing controller is configured to perform a scan operation for the third area in a sequential addressing manner after performing another scan operation from a boundary of the first area and the third area toward the fourth area in the sequential addressing manner.

In an embodiment, the first area is disposed at one end of the display panel with respect to a first direction in which the data lines travel, and the timing controller is configured to perform a scan operation in a direction from the first area toward the second area in a sequential addressing manner.

In an embodiment, the timing controller is configured to adjust an emission duration by varying a first scan speed at which the data voltages are applied to the first pixels in the first area and a second scan speed at which the data voltages are applied to the second pixels in the second area, the first scan speed equal to the second scan speed, the emission duration being a time interval from a point at which the pixels are turned on to a point at which the pixels are turned off.

In an embodiment, the timing controller is configured to make the emission duration in the second area gradually decrease as a distance from the first area increases by making a third scan speed of the reset signals for turning off the second pixels in the second area be higher than the second scan speed.

In an embodiment, the timing controller is configured to adjust data gradation corresponding to the data voltages applied to the second pixels in the second area upward as the distance from the first area increases.

In an embodiment, the timing controller is configured to adjust an emission duration from a point at which the pixels are turned on to a point at which the pixels are turned off, by varying a first scan speed at which the data voltages are supplied to the first pixels in the first area to be different from a second scan speed at which the data voltages are supplied to the second pixels in the second area.

In an embodiment, when changing a width of the first area with respect to a first direction in which the data lines travel, the timing controller is configured to adjust a light emission start point at which the first pixels are simultaneously turned on back and forth by using a first scan speed at which the data voltages are applied to the first pixels in the first area and a second scan speed at which the data voltages are applied to the second pixels in the second area equal to the first scan speed, or varying the first scan speed and the second scan speed while fixing the light emission start point.

In an embodiment, the timing controller is configured to lower a power supply voltage supplied to the pixels by controlling a power generator responsive to increasing an emission duration from a point at which the pixels are turned on to a point at which the pixels are turned off.

In an embodiment, each of the pixels may compise a light emitting element, a driving transistor for controlling a driving current through the light emitting element according to a gate-source voltage, a first transistor for connecting the data line and a gate electrode of the driving transistor according to the scan signals, a capacitor for storing the data voltages applied through the data line, and a second transistor for initializing the driving transistor and the light emitting element and turning off the light emitting element according to the reset signals.

In an embodiment, the gate driving circuit is configured to simultaneously supply the reset signals to the first pixels after an emission duration elapses since the first pixels are simultaneously turned on, and to sequentially supply the reset signals to the second pixels in a unit of the plurality of horizontal lines after simultaneously supplying the reset signals.

In an embodiment, the timing controller is configured to control a power generator not to supply a power supply voltage to the first pixels during applying the data voltages to the first pixels.

In an embodiment, the first area and the second area are disconnected from each other, and the timing controller is configured to supply a power supply voltage to the first pixels during an emission duration of the first pixels and supply the power supply voltage to the second pixels during a period of time in which the data voltages are applied to the second pixels and another emission duration of the second pixels.

The light emission duration may be easily varied by driving the VR display device by applying scan methods and emission methods differently in the focus area and the peripheral area. In addition, by increasing the light emission duration, the brightness may be improved and the VR dizziness may be reduced, thereby increasing the immersion and satisfaction of the user using a VR device.

Further, power consumption of the VR device may be reduced by varying a power supply voltage applied to a panel while adjusting the light emission duration. Also, the power supply voltage applied to the panel may be instantaneously increased to rapidly increase the brightness, thereby increasing the user's immersion.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Figure 1A:
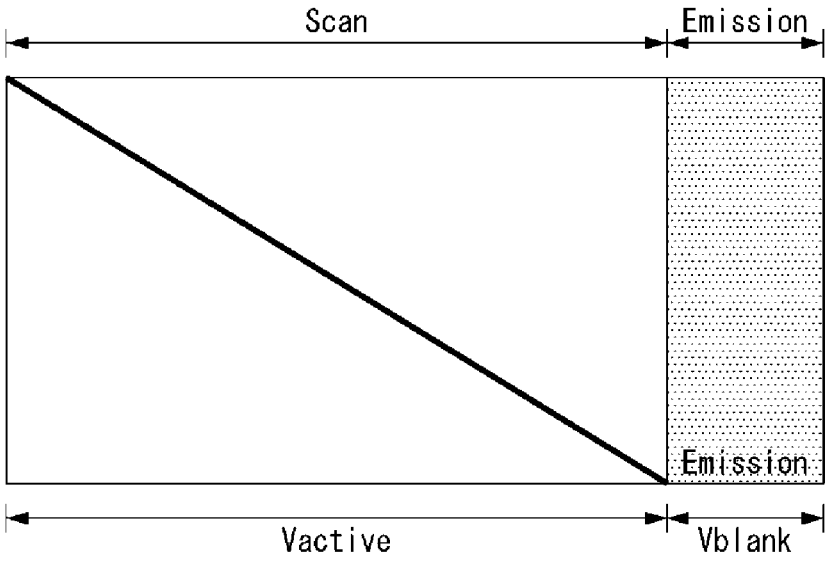
FIGS. 1A and 1B conceptually show a global shutter method for simultaneously emitting a plurality of horizontal lines and a rolling shutter method for sequentially emitting horizontal lines, respectively.

Hereinafter, preferred embodiments of the present disclosure will be described in detail with reference to the accompanying drawings. Same reference numerals throughout the specification denote substantially identical components. In the following description, a detailed description of known functions and configurations incorporated herein will be omitted when it may make the subject matter of the present disclosure rather unclear.

Figure 1B:
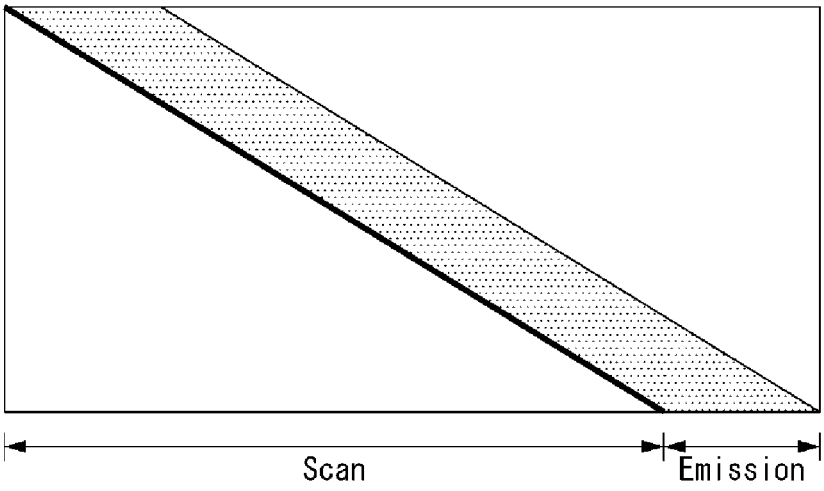

FIGS. 1A and 1B conceptually show a global shutter method for simultaneously emitting a plurality of horizontal lines and a rolling shutter method for sequentially emitting horizontal lines, respectively.

The global shutter method is the method of sequentially writing data in horizontal lines included in a panel and making the pixels of all horizontal lines simultaneously emit light after all horizontal lines are written with data. And, the rolling shutter method makes the horizontal lines written with data sequentially emit light while sequentially writing data on the horizontal lines.

For example, when a frame rate is 120 Hz, a resolution is 4,800 in a vertical direction, that is, the number of horizontal lines is 4,800 (Vactive=4,800 lines), and ¼ time of scanning 4,800 lines is allocated to a light emitting time (Vblank=1,200 lines), 1 horizontal period 1H is 1/120/6,000=1.39 usec, and the light emission duration is 1.67 msec corresponding to 1,200 horizontal periods. The emission duration is a time interval from a point at which the pixels are turned on to a point at which the pixels are turned off.

There is a tendency to employ the global shutter method to reduce a VR sickness in consideration of the characteristics of an application or an image reproduced from the VR display device. The brightness of the light emitting diode is proportional to a light emission duration, so it is difficult to increase the brightness at a limited light emission duration. Further, in the immersion type VR display device requiring an ultra high resolution, a pixel density is increased and the aperture ratio of the pixel is lowered, making it much difficult to increase the brightness.

When the scan is sequentially performed in a same direction in the general active matrix system as shown in FIG. 1A or FIG. 1B, one horizontal period 1H and the light emission duration are determined by the time allocated to one frame and are difficult to change, and accordingly, it is difficult to raise the luminance or brightness.

Because of the characteristics of the VR display device operating in proximity to user's eyes, a central portion or a focus area (or FOV area) among a display area where a user can clearly recognize image is limited, and a non-FOV area except for the focus area is difficult for the user to recognize the image clearly.

Thus, a foveated rendering technique for displaying the image processed with a high resolution in the focus area and the image processed in a low-resolution in the peripheral area is also used for the VR display device.

Considering this situation, it is difficult to optimally realize the image quality of the VR display device by applying a same and constant scan method over an entire display area as shown in FIG. 1A or FIG. 1B.

Figure 2:
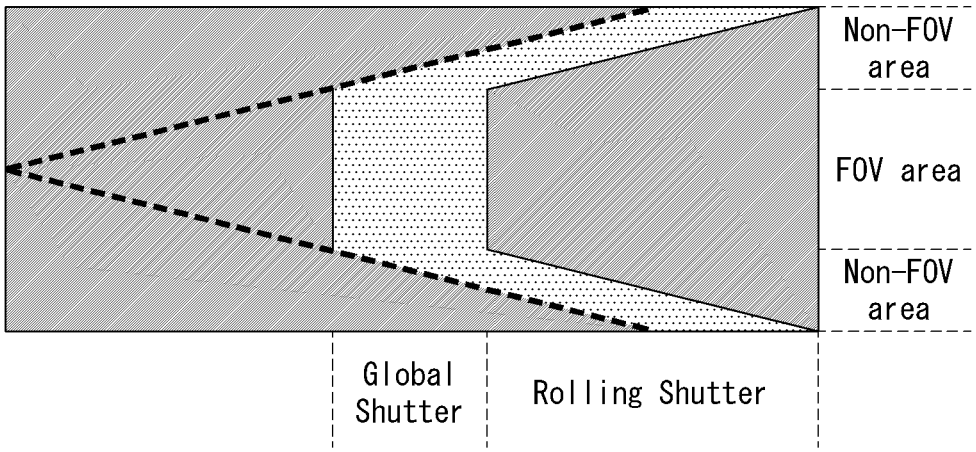
FIG. 2 conceptually illustrates an embodiment in which a focus area is driven by a global shutter method and a peripheral area is driven by a rolling shutter method according to the present disclosure.

FIG. 2 conceptually illustrates an embodiment in which the focus area is driven by the global shutter method and the peripheral area is driven by the rolling shutter method according to the present disclosure. The focus area and the peripheral area may be electrically disconnected from each other.

In FIG. 2, along the vertical axis the display area is divided into a focus area (or a first area or FOV area) in a central portion and a peripheral area (or a second area or non-FOV area) in a peripheral portion, and the horizontal axis indicates time. The dotted line indicates the progress of the scan operation for writing data to the pixels of each horizontal line. The bright portion indicates that one or more pixels are made to emit light, and the dark portion to the right of the bright portion indicates that one or more lighted pixels turned off.

In the present disclosure, the display performance of a high-resolution VR display device is improved by differently applying scan methods temporally and spatially. Since the focus area (FOV area) in the central portion of the display area is important for image quality, by applying the global shutter method to the focus area and applying the rolling shutter method to the peripheral area (Non-FOV area) as shown in FIG. 2, the light emission duration may be easily changed and the brightness may be adjusted.

In FIG. 2, the scan proceeds from the focus area, which is the central portion, to the peripheral area. In the focus area, according to the global shutter method, data is written to the pixels of the horizontal lines, the pixels of the horizontal lines written with the data are simultaneously emitted, and the pixels of the horizontal lines are simultaneously extinguished (turned off) after a predetermined time elapses. In the peripheral area, according to the rolling shutter method, the operations are sequentially performed of writing data in each horizontal line, making the horizontal line emit light, and turning off the horizontal line after a predetermined time elapses.

Figure 3:
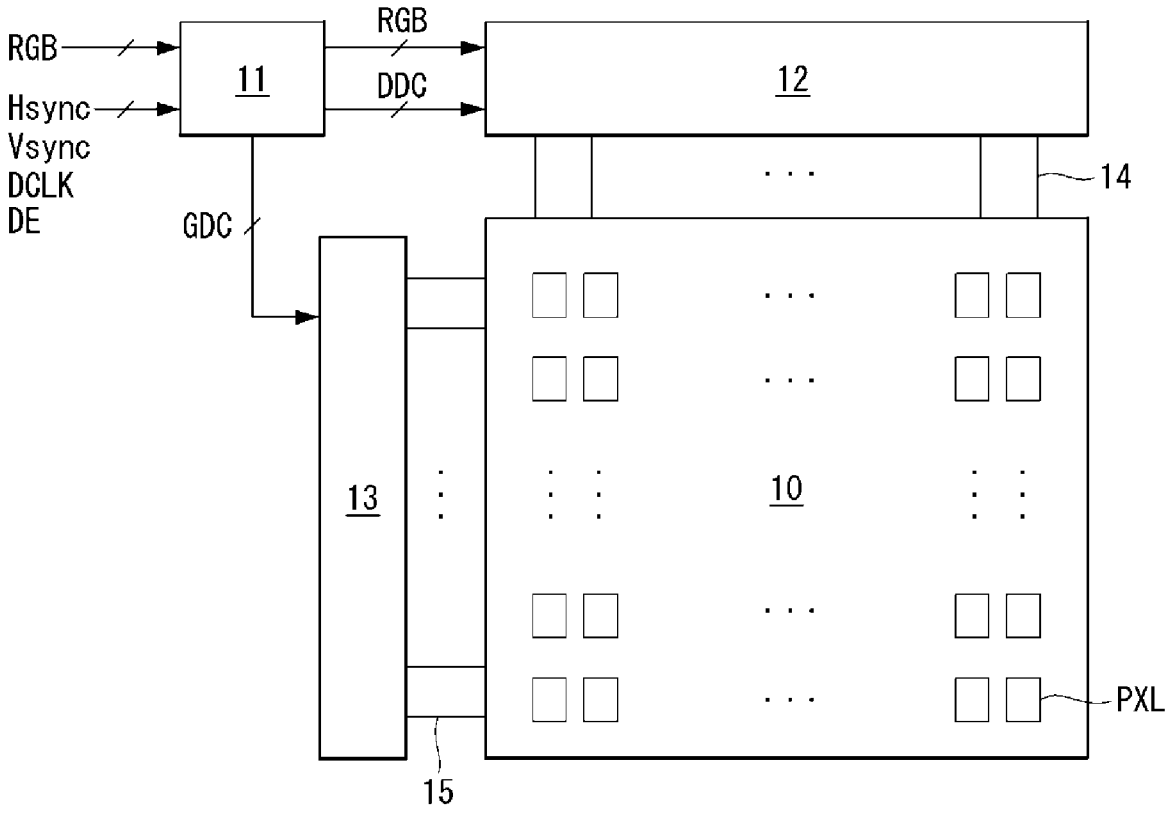
FIG. 3 is a block diagram of a display device according to an embodiment of the present disclosure.

FIG. 3 is a block diagram of a display device according to an embodiment of the present disclosure. The display device may comprise a display panel 10, a timing controller 11, a data driving circuit 12, and a gate driving circuit 13. The display device according to the present disclosure may operate as a virtual reality device by being mounted on HMD, FMD, EGD, or the like as a pair for left and right eyes.

In the display panel 10, a plurality of data lines 14 arranged in a column direction and a plurality of scan lines (or gate lines) 15 arranged in a row direction cross each other, and pixels PXL are arranged in a matrix form for each crossing region to form a pixel array. Scan signals for controlling the application of a data voltage are supplied to the scan lines 15.

The scan lines 15 may further include a plurality of second scan lines to which second scan signals for controlling the application of data voltages or a reference voltage are supplied and a plurality of emission lines to which emission signals for controlling the emission of light emitting elements are supplied, depending on the circuit configuration of the pixel PXL constituting the display panel 10.

In the pixel array, each pixel PXL is connected to one of the data lines 14 and one of the scan lines 15, and pixels PXL disposed on a same horizontal line form a pixel line. The pixel is electrically connected to the data line 14 in response to a scan signal input through the scan line 14 to receive a data voltage. The pixels arranged in a same pixel line operate simultaneously according to the scan signal applied from a same scan line 15.

The pixels may be supplied with a high potential driving voltage, a low potential driving voltage, a reference voltage, or an initialization voltage from a power generator (not shown). The pixel includes a light emitting element, a driving transistor, a storage capacitor, and a plurality of switch transistors to drive the light emitting element with a current proportional to a data voltage applied through the data line. The pixel may further include a compensation circuit to compensate for the threshold voltage of the driving transistor. The light emitting element may be an inorganic electroluminescent element or an organic light emitting diode (OLED) element. Hereinafter, the OLED will be described as an example for convenience. A specific structure of the pixel circuit according to the embodiment of the present disclosure will be described later with reference to FIG. 4.

The TFTs constituting the pixel may be implemented as a p-type or an n-type or as a hybrid type in which P-type and N-type are mixed. In addition, the semiconductor layer of the TFTs may include amorphous silicon, polysilicon, or an oxide.

A transistor is the element of three electrodes including a gate, a source and a drain. The source is an electrode for supplying a carrier to the transistor. Within the transistor, the carrier begins to flow from the source. The drain is an electrode from which the carrier exits the transistor. That is, the flow of carriers in the MOSFET is from the source to the drain.

It should be noted that the source and drain of the MOSFET are not fixed. For example, the source and drain of the MOSFET may vary depending on the applied voltage. In the following embodiments, the invention should not be limited due to the source and drain of the transistor, and the source and drain electrodes may be referred to as first and second electrodes without distinguishing between the source and the drain electrodes.

The timing controller 11 supplies image data RGB transmitted from an external host system (not shown) to the data driving circuit 12. The timing controller 11 receives, from the host system, timing signals, such as a vertical synchronization signal Vsync, a horizontal synchronization signal Hsync, a data enable signal DE, a dot clock signal DCLK, and the like, and generates control signals for controlling the operation timings of the data driving circuit 12 and the gate driving circuit 13, based on the timing signals. The control signals may include the gate timing control signals GDC for controlling the operation timings of the gate driving circuit 13 and the data timing control signals DDC for controlling the operation timings of the data driving circuit 12.

The timing controller 11 may drive one frame during which the image data constituting one screen is applied to the pixels constituting the display panel 10 by dividing one frame into at least an initialization period, a data writing period, and an emission period.

The data driving circuit 12 samples and latches the digital image data RGB input from the timing controller 11 to parallel data, converts the digital video data RGB into an analog data voltage according to gamma reference voltages, and outputs the converted digital video data RGB to the data line 14 through an output channel, under the control of the timing controller 11. The data voltage may be a value corresponding to an image signal to be represented by an organic light emitting element.

The gate driving circuit 13 may generate scan signals while shifting the level of a gate driving voltage in a row sequential manner and sequentially supply them to the scan lines connected to respective pixel lines, based on the gate control signals GDC. The emission signal applied to the pixel circuit may control the emission duration of the pixel.

The gate driving circuit 13 may further generate second scan signals for applying an initialization voltage to the pixels or emission signals for emitting pixels. In this case, a second scan driver and an emission driver may be separately formed from a scan driver for generating the scan signals in the gate driving circuit 13.

The gate driving circuit 13 may generate the emission signals in a row sequential manner and sequentially supply the emission signals to the emission lines when employing the rolling shutter method, and may simultaneously supply the emission signal to a plurality of pixel lines after completing the data writing to the plurality of pixel lines when employing the global shutter method. The emission signal applied to the pixel circuit may adjust the emission duration of the pixel.

The gate drive circuit 13 may comprise a plurality of gate driving ICs each including a shift register, a level shifter for converting an output signal of the shift register into a signal having a swing magnitude suitable for driving TFTs of the pixel, and an output buffer. In an embodiment, the gate driving circuit 13 may be formed directly on the lower substrate of the display panel 10 by a GIP (Gate drive IC in Panel) method. In case of the GIP method, the level shifter may be mounted on a printed circuit board PCB and the shift resister may be formed on the lower substrate of the display panel 10.

The gate control signal GDC includes a gate start pulse GSP, a gate shift clock GSC, a gate output enable signal GOE, and the like. The gate start pulse GSP controls the output start timing of the gate pulse or the scan pulse. The gate shift clock GSC is input to the shift register to control the shift timing of the shift resister. The gate output enable signal GOE defines the output timing of the gate pulse.

The power generating unit (not shown) generates and supplies voltages required for the operations of the data driving circuit 12 and the gate driving circuit 13 by using an external power supply, and supplies a high potential driving voltage, a low potential driving voltage, a reference voltage, an initialization voltage, and the like to the display panel 10.

The host system connected to an embodiment of the display device of the present disclosure for executing a virtual reality application while providing image data may control the resolutions of the focus area and the peripheral area differently by using a graphic image processor such as a GPU.

The host system may receive video data from a camera attached to the VR device, track the user's pupils based on the received video data or grasp the movement of the user based on the sensor output of a gyro sensor or an acceleration sensor attached to the VR device, estimate the position where the user is concentrating (e.g., based on gaze direction or pupil tracking) on the display panel, and adjust the position of the focus area or the size of the focus area based on the estimated position.

The host system transmits information such as the size, position, and light emission duration of the focus area to the timing controller 11 together with image data. The timing controller 11 changes the order of the image data to be supplied to the data driving circuit 12 and controls the operations of the data driving circuit 12 and the gate driving circuit 13 by generating the data control signals DDC and the gate control signals GDC.

Figure 4:
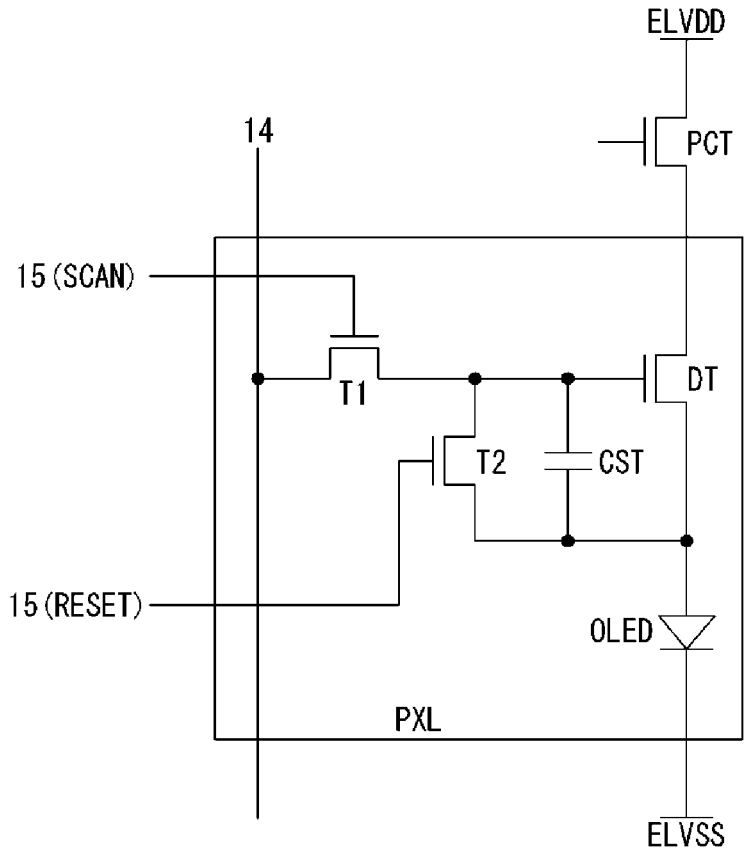
FIG. 4 illustrates a circuit of a pixel according to an embodiment of the present disclosure.

FIG. 4 illustrates a circuit of a pixel according to an embodiment of the present disclosure, and FIGS. 5A, 5B, 5C, and 5D show control signals for driving the pixels shown in FIG. 4 by the global shutter method and the rolling shutter method for areas shown in FIG. 2 and a block for generating the control signals, according to an embodiment.

One pixel is composed of a 2T (Transistor) 1C (Capacitor) structure including a switching transistor T1, a driving transistor DT, a storage capacitor CST, and an OLED. However, when a compensation circuit is added, the structure of the pixel may be 4T2C, 5T2C, and the like.

The circuit driving the OLED in the embodiment shown in FIG. 4 is composed of 3 transistors and 1 capacitor.

The OLED emits light by the driving current supplied from the driving transistor DT, and the driving transistor DT controls the driving current applied to the OLED according to its source-gate voltage VSG.

The anode electrode of the OLED is connected to the driving transistor DT and the cathode electrode of the OLED is connected to a low potential power supply line ELVSS.

The driving transistor DT includes a first electrode connected to a high potential power supply line ELVDD for supplying the high potential driving voltage, a gate electrode connected to a first node, and a second electrode connected to the anode electrode of the OLED. Since the driving transistor DT is of an N type, the first electrode may be a drain electrode and the second electrode may be a source electrode.

The first electrode of the driving transistor DT is connected to the high potential power supply line ELVDD through a power control transistor PCT, and the emission start timing of the OLED may be controlled through the power control transistor PCT.

The storage capacitor CST is connected to the gate electrode and the second electrode of the driving transistor DT and maintains the data voltage applied to the gate electrode of the driving transistor DT.

A first transistor T1 includes a first electrode connected to the data line 14, a gate electrode connected to the scan line 15, and a second electrode connected to the storage capacitor CST. The first transistor T1 causes the data voltage supplied through the data line 14 to be stored in the storage capacitor CST in response to the scan signal SCAN supplied through the scan line 15.

A second transistor T2 includes a first electrode connected to the gate electrode of the driving transistor DT, a gate electrode connected to a second scan line 15 for supplying a reset signal RESET, and a second electrode connected to the second electrode of the driving transistor DT. The second transistor T2 may initialize the driving transistor DT and the storage capacitor CST in response to the reset signal RESET supplied through the second scan line 15 prior to data writing, and stop the emission of light from the OLED. The resest signal RESET is for turning off the pixels emitting light.

In FIG. 4, the second transistor T2 is configured such that the first electrode is connected to the gate electrode of the driving transistor DT. However, the first electrode may be connected to an initialization power line to which the initialization voltage is applied so as to initialize the driving transistor DT and the OLED before writing data to the pixels or to stop the emission of the OLED.

Figure 5A:
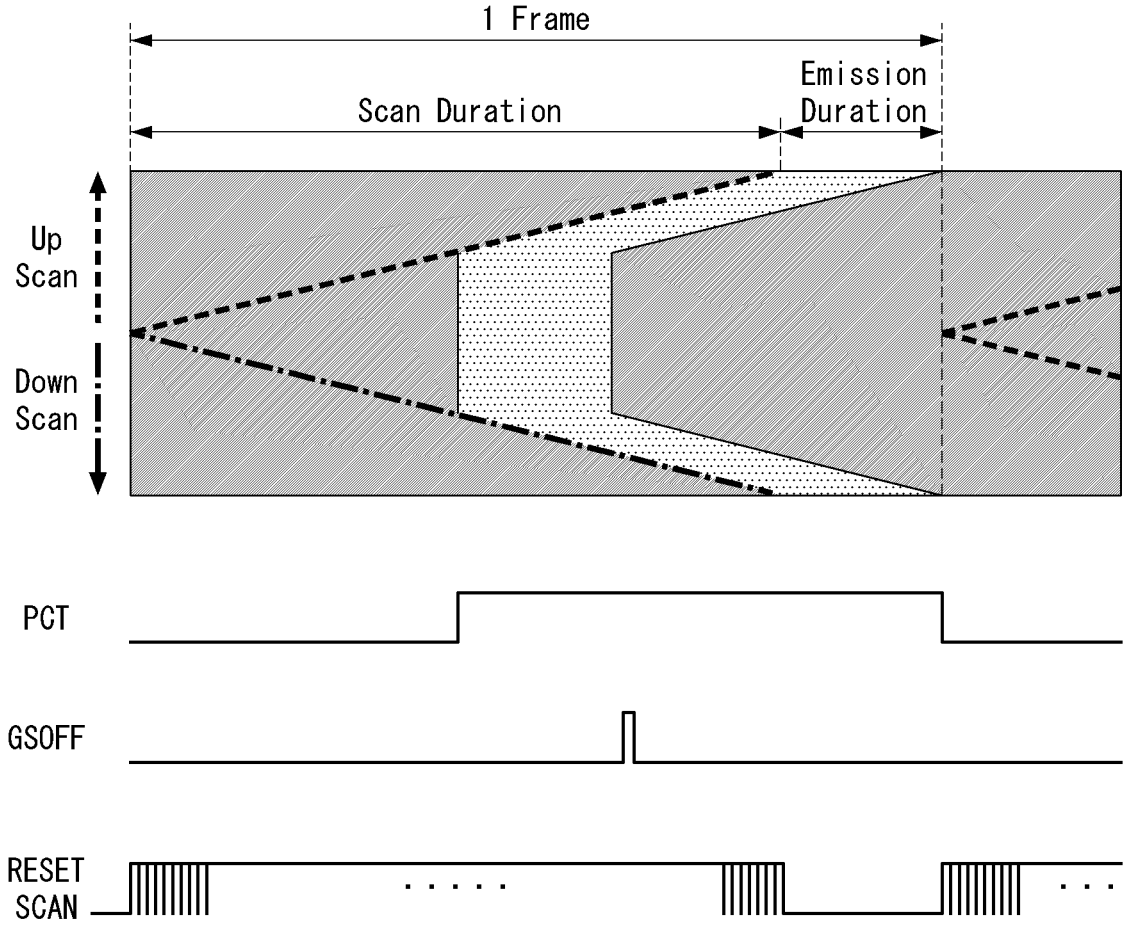
FIGS. 5A, 5B, 5C, and 5D show control signals for driving the pixels shown in FIG. 4 by the global shutter method and the rolling shutter method for areas shown in FIG. 2 and a block for generating the control signals, according to an embodiment.

As shown in FIG. 5A, after all the pixel lines included in the FOV area are scanned, that is, after data is written, the focus area is simultaneously emitted, and the pixel lines included in the non-FOV area sequentially emit light while being sequentially scanned. Since the OLEDs in both the focus area and the peripheral area emit light, the pixels in the focus area and the peripheral area are reset after a predetermined time elapses to stop the light emission.

The time of one frame includes the scan duration during which all pixel lines are scanned and the emission duration during which respective pixel lines emit light. Since starting to emit light, each pixel line is reset to stop the light emission after the emission duration elapses.

In FIG. 5A, the scan operation of writing data to the pixel lines starts from the central portion of the display panel 10 and proceeds to the upper and lower portions of the display panel 10. The scan operation may be performed by alternating the up scan that goes from the center of the display panel 10 to the top of the display panel 10 and the down scan that goes from the center to the bottom of the display panel 10 at an interval of one horizontal period.

Figure 5B:
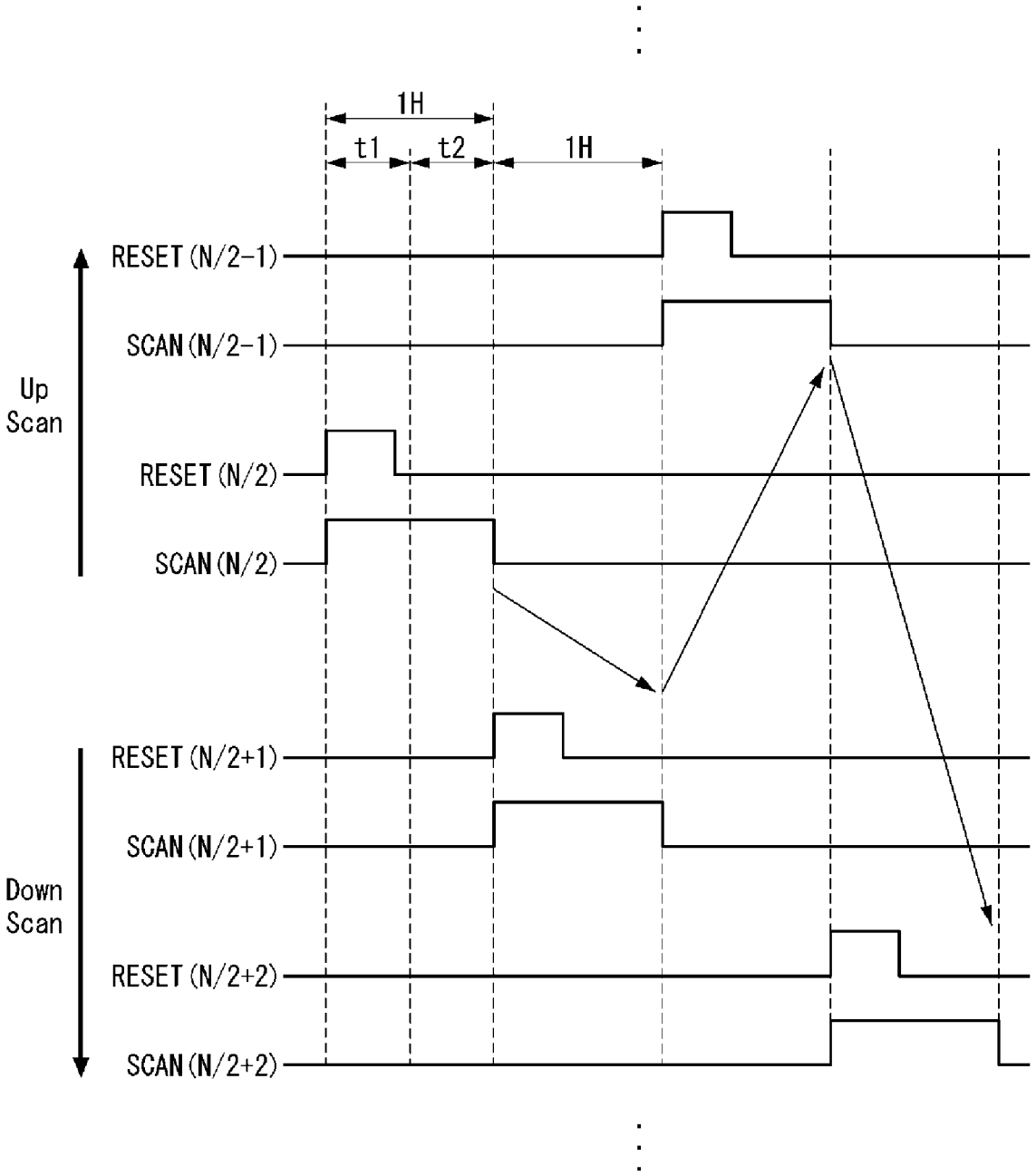

As shown in FIG. 5B, when the vertical resolution of the display panel 10 is N, scan/reset signals SCAN and RESET are supplied to the N/2 pixel line, scan/reset signals SCAN and RESET are supplied to the (N/2+1) pixel line, scan/reset signals SCAN and RESET are supplied to the (N/2−1) pixel line, and then scan/reset signals SCAN and RESET are supplied to the (N/2+2) pixel line. Thus, the scan operation is performed in the up and down directions by alternately performing the up scan and the down scan every one horizontal period 1H.

Since the up scan and the down scan alternate with each other and proceed from the center to the top and bottom of the display panel, this scan operation may be called "ping-pong addressing." This ping-pong addressing is performed during the scan duration until data is written to both the focus area and the peripheral area.

One horizontal period 1H indicates a period of applying data voltages to one pixel line, and may be composed of a first period (or an initialization period) t1 during which the driving transistor DT and the OLED are initialized and a second period (or a data writing period) t2 during which a data voltage is applied to the storage capacitor CST.

In the first period t1, the scan signal SCAN and the reset signal RESET become a high logic level, which can turn on the first and second transistors T1 and T2. In the second period t2, the scan signal SCAN maintains its high logic level to turn on the first transistor T1 and the reset signal RESET becomes a low logic level to turn off the second transistor T2.

In the second period t2, the source output enable signal SOE is activated so that the source drive IC of the data driving circuit 12 supplies the data voltage to the data line 14, and the data voltage is stored in the storage capacitor CST through the first transistor T1 in the turn-on state, so data is written to the pixel.

If the data writing to the pixel lines in the focus area (FOV area) is completed, the power control transistor TCT is turned on to supply the high potential power voltage ELVDD to the driving transistor DT of the pixel included in the focus area, thereby causing the pixels in the focus area to emit light. The power control transistor PCT maintains its turn-on state until the pixels of the uppermost and lowermost pixel lines, which are included in the peripheral area and data is last written to, start emitting light and the emission duration elapses. The power control transistor PCT is turned off when a next frame starts.

Figure 5C:
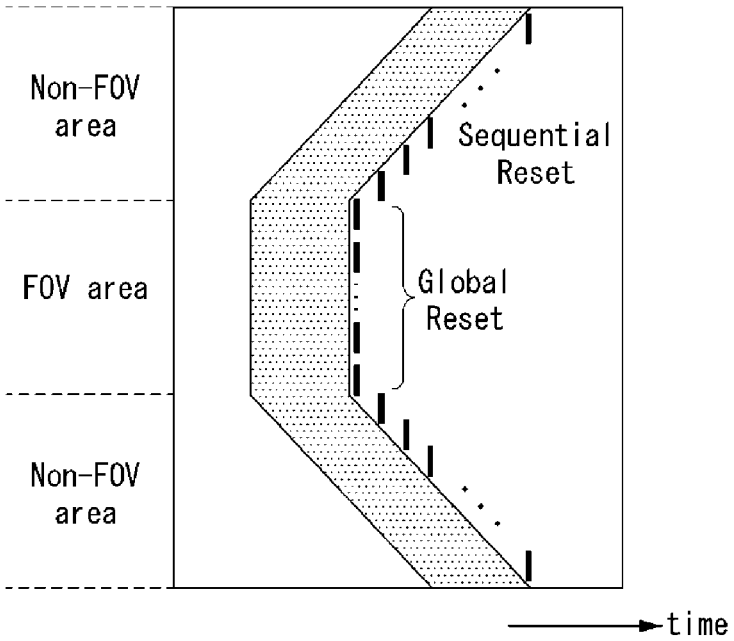

As shown in FIG. 5C, the pixels in the focus area (FOV area) that simultaneously emit light (during an emission duration) simultaneously stop the light emission when the emission duration elapses (after the emission duration), and the pixels in the peripheral area (Non-FOV area) which sequentially emit light sequentially stop the light emission after the light emission starts and then the emission duration elapses. So, as shown in FIG. 5A, a global shutter-off signal GSOFF is supplied in a pulse form after the emission duration elapses after the focus area starts emitting light.

The timing controller 11 may generate the global shutter-off signal GSOFF based on the emission duration information transmitted from the host system and supply the global shutter-off signal GSOFF to the gate driving circuit 13. Also, the timing controller 11 may generate the signal for controlling the power control transistor PCT based on the size and/or position information of the focus area transmitted from the host system and supply the signal to the power generator, thereby controlling the supply timing of the high potential power voltage ELVDD supplied to the display panel 10 or the emission start timing of the focus area.

Figure 5D:
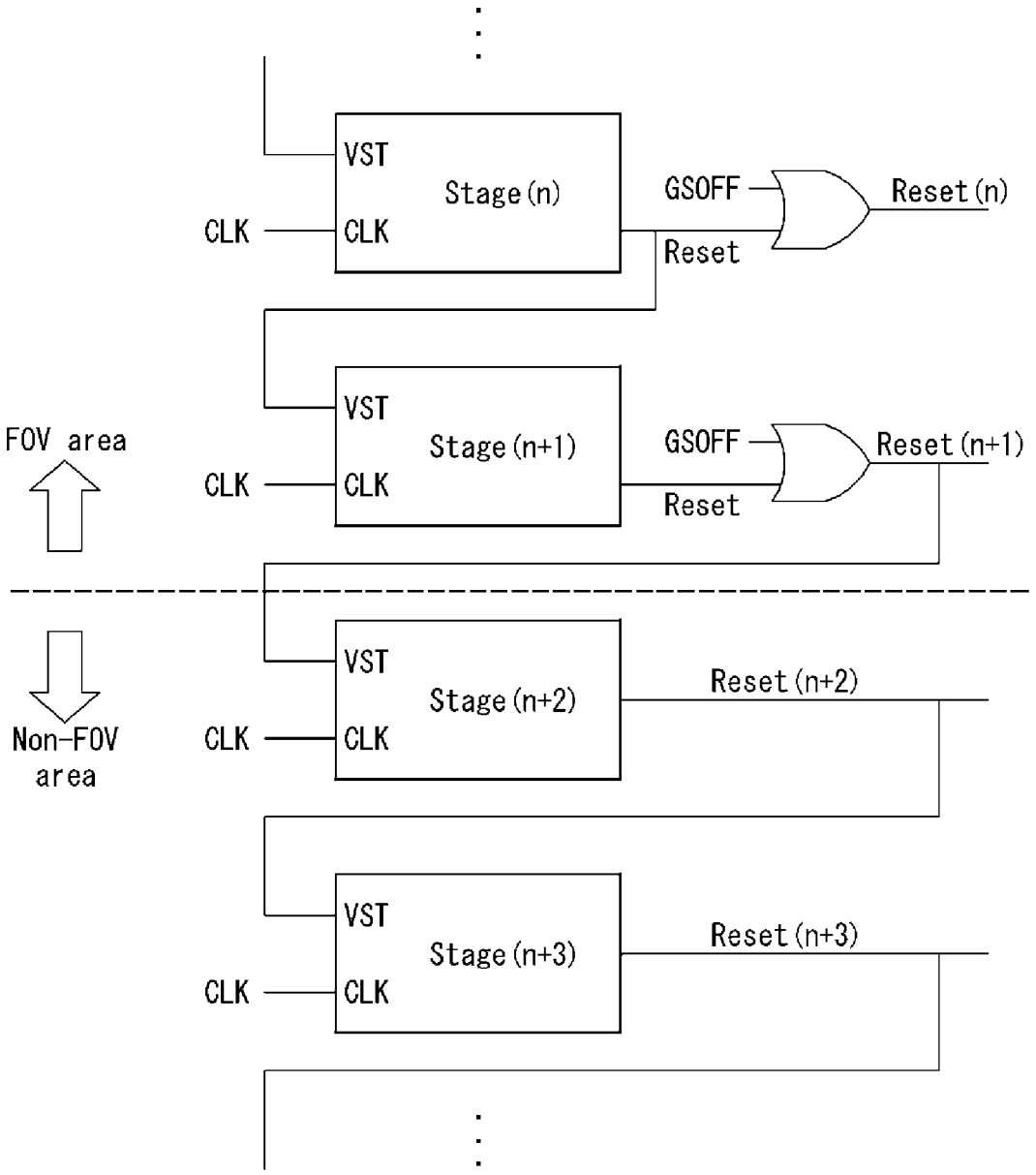

FIG. 5D shows a configuration of a reset driver for generating and outputting a reset signal at a boundary between the focus area and the peripheral area. The gate driving circuit 13 includes the reset driver for generating the reset signal and outputting the reset signal to the pixel lines. The reset driver comprises a shift register for sequentially generating and outputting the reset signals, and the shift register comprises a plurality of stages (or D flip-flops) connected in a cascaded manner. Each stage corresponding to each pixel line receives a start pulse VST or a carry signal from a previous stage as the start pulse and generates and outputs the reset signal RESET in synchronization with a clock signal CLK.

The output signals Reset of stages (Stage(n) and Stage (n+1) in FIG. 5D) corresponding to the pixel lines of the focus area (FOV area) is OR-processed with the global shutter-off signal GSOFF and supplied to the corresponding pixel lines as reset signals Reset(n) and Reset(n+1) as shown in FIG. 5D. So, the pixels of all pixel lines included in the focus area which start to simultaneously emit light are reset simultaneously according to the pulse of the global shutter-off signal GSOFF, and the simultaneous light emission is stopped simultaneously (Global Reset) after the emission duration has elapsed.

The stage (Stage(n+2) in FIG. 5D) corresponding to a first pixel line of the peripheral area (Non-FOV area) receives, as a start pulse, the result of OR logic processing of the global shutter-off signal GSOFF and the output signal of the stage (Stage(n+1) in FIG. 5D) of a last pixel line of the focus area and generates and outputs a reset signal Reset(n+2). The stage (Stage(n+3) in FIG. 5D) corresponding to a second pixel line of the peripheral area receives the reset signal Reset(n+2) of Stage(n+2) as the start pulse, and generates and output the reset signal Reset(n+3). So, it is possible to sequentially stop the emission of the pixels of the pixel lines in the peripheral area by sequentially supplying the reset signals to the pixel lines in the peripheral area (Sequential Reset).

In the reset driver in FIG. 5D, the reset signal output of all the stages is OR-processed with the global shutter-off signal GSOFF without distinguishing the focus area and the peripheral area. The global shutter-off signal GSOFF applied to the stages of the focus area and the global shutter-off signal GSOFF applied to the stages of the peripheral area may be processed differently. That is, since the width or position of the focus area may be changed, the global shutter-off signal GSOFF may be AND-processed first with the signal that distinguishes the focus area and the peripheral area, and then applied to each stage. Accordingly, even when the position or size of the focus area changes, a reset signal is simultaneously output corresponding to the global shutter-off signal GSOFF in the focus area, and reset signals are sequentially output in synchronization with the reset signal of the focus area in the peripheral area.

Since the scan operation proceeds from the center of the display panel to the top and bottom, the host system may change the order of transmitting image data. Or the host system sequentially transmits the image data from the top pixel line to the bottom pixel line, but the timing controller 11 may receive the image data on a frame-by-frame basis using a frame memory and then supply the image data to the data driving circuit 12 in a different order.

Figure 6:
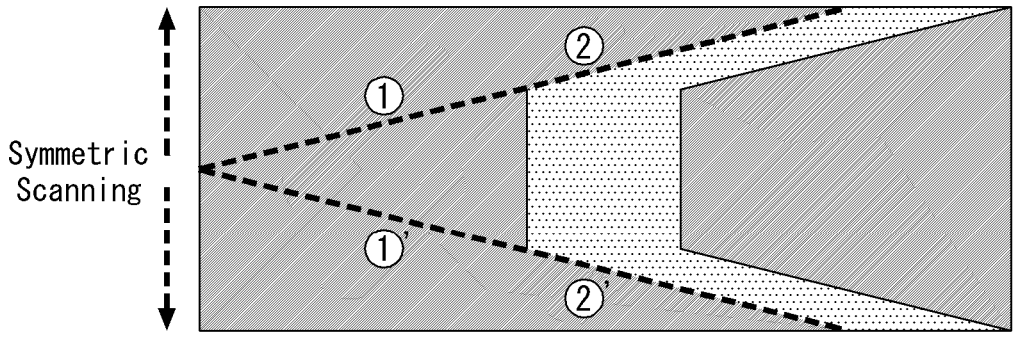
FIG. 6 conceptually illustrates addressing data in a ping-pong manner in both the focus area and the peripheral area according to an embodiment of the present disclosure.
Figure 7:
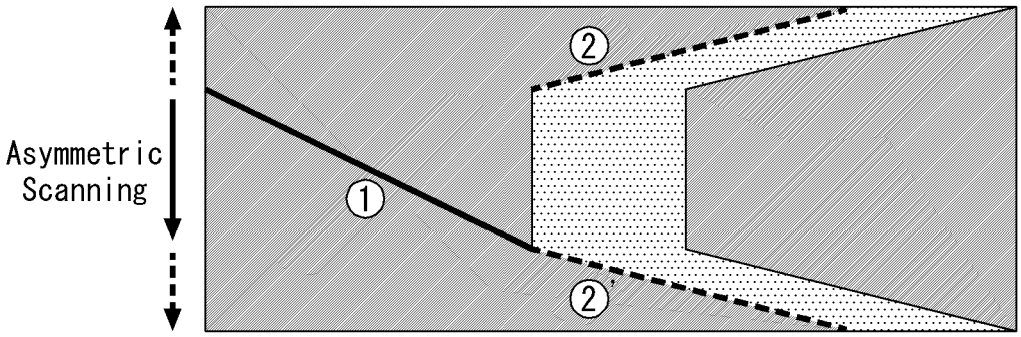
FIG. 7 conceptually illustrates addressing data in a sequential manner in the focus area and addressing data in a ping-pong manner in the peripheral area according to another embodiment of the present disclosure.

FIG. 6 conceptually illustrates addressing data in a ping-pong manner in both the focus area and the peripheral area according to an embodiment of the present disclosure, and FIG. 7 conceptually illustrates addressing data in a sequential manner in the focus area and addressing data in a ping-pong manner in the peripheral area according to another embodiment of the present disclosure.

Since the focus area simultaneously emits light after data is written to all the pixel lines according to the global shutter method, there may be no problem even if data is written symmetrically in both directions in a ping-pong addressing manner or asymmetrically in one direction in a sequential addressing manner. However, it is advantageous to perform the scan operation symmetrically in both directions in the peripheral area since the pixels in the peripheral area sequentially emit light after the focus area start emitting lights.

In FIG. 6, a symmetric scan operation may be performed in both directions from the center of the display panel 10 to the upper and lower sides with respect to the vertical direction, and the scan operation ① and ①' for the focus area and the scan operation ② and ②' for the peripheral area are both performed symmetrically in the ping-pong addressing method.

In FIG. 7, while an asymmetric scan operation ① is performed in the focus area according to a sequential addressing method, a symmetric scan operation ② and ②' is performed in the peripheral area according to the ping-pong addressing method.

Figure 8A:
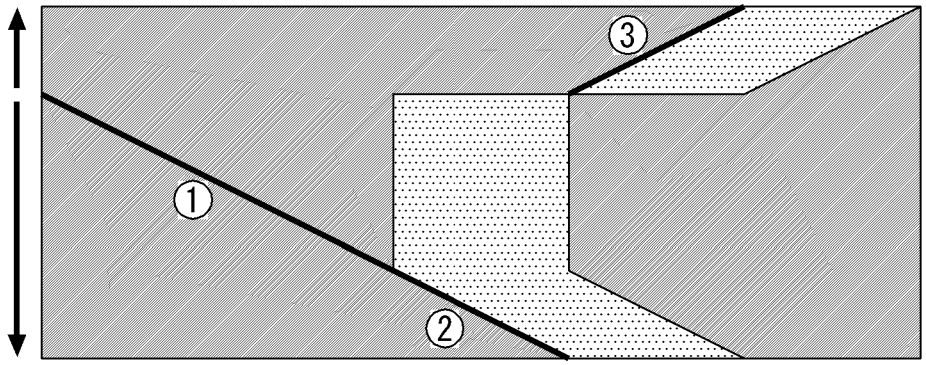
FIGS. 8A, 8B, and 8C are conceptual diagrams for addressing both the focus area and the peripheral area in a sequential manner according to another embodiment of the present disclosure.
Figure 8B:
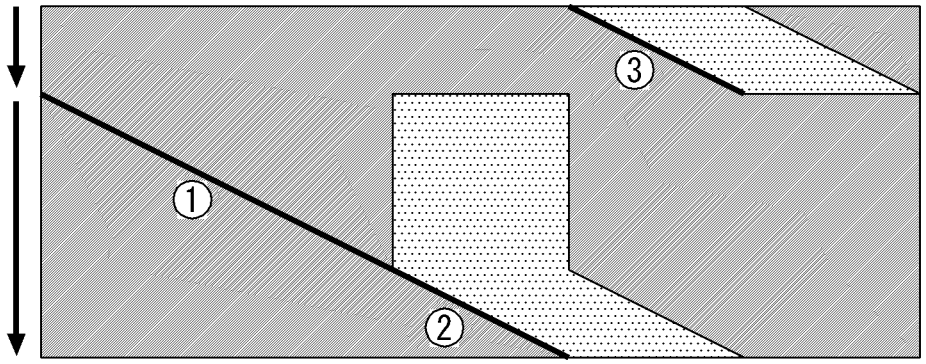
Figure 8C:
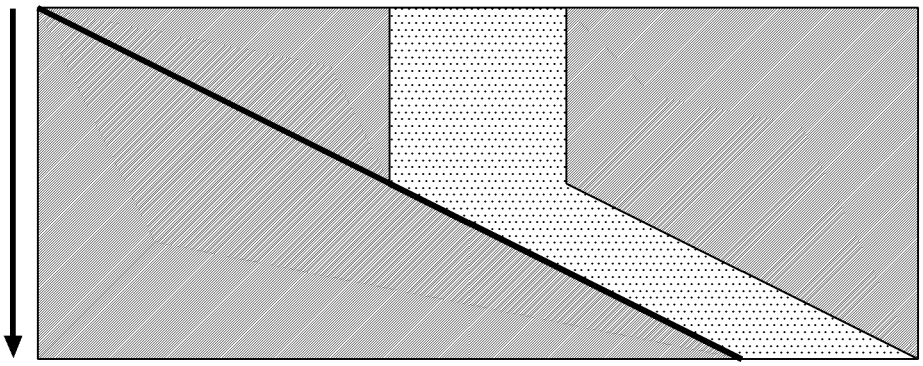

FIGS. 8A, 8B, and 8C are conceptual diagrams for addressing both the focus area and the peripheral area in a sequential manner according to another embodiment of the present disclosure.

As shown in FIG. 8A, after sequentially addressing the focus area and the peripheral area located below the focus area from top to bottom ① and ②, the peripheral area located above the focus area may be addressed sequentially from bottom to top ③.

Or, as shown in FIG. 8B, after sequentially addressing the focus area and the peripheral area located below the focus area from top to bottom ① and ②, the peripheral area located above the focus area may be addressed sequentially from top to bottom ③.

Or, as shown in FIG. 8C, in case that the focus area is offset to the top or bottom rather than to the center of the display panel, addressing may be sequentially performed in one direction from the focus area to the peripheral area.

In FIGS. 8A to 8C, the top and bottom are relative concepts, the direction related to the top and bottom may be reversed, and the direction of top and bottom do not limit the claim scope.

Figure 9A:
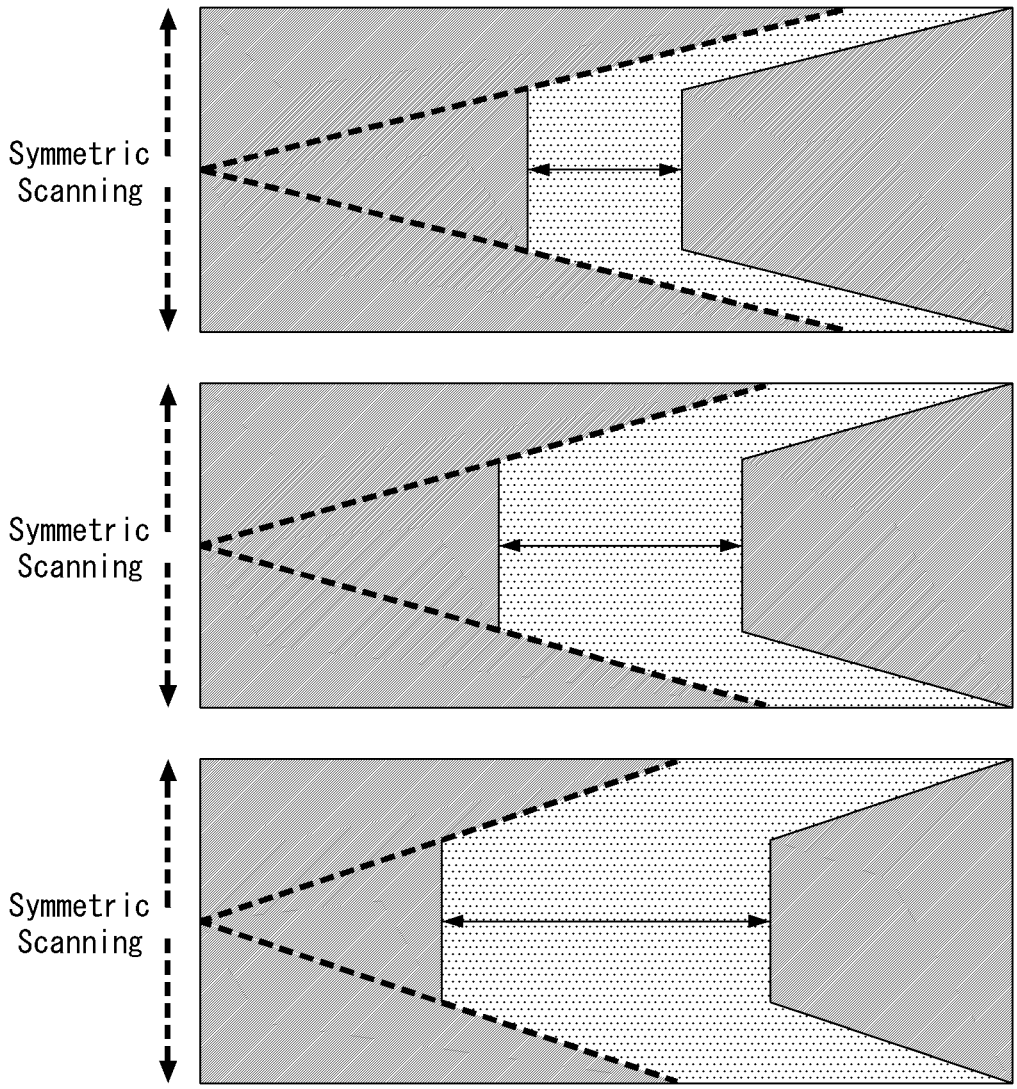
FIGS. 9A and 9B show embodiments in which an emission duration is increased by adjusting a scan speed.
Figure 9B:
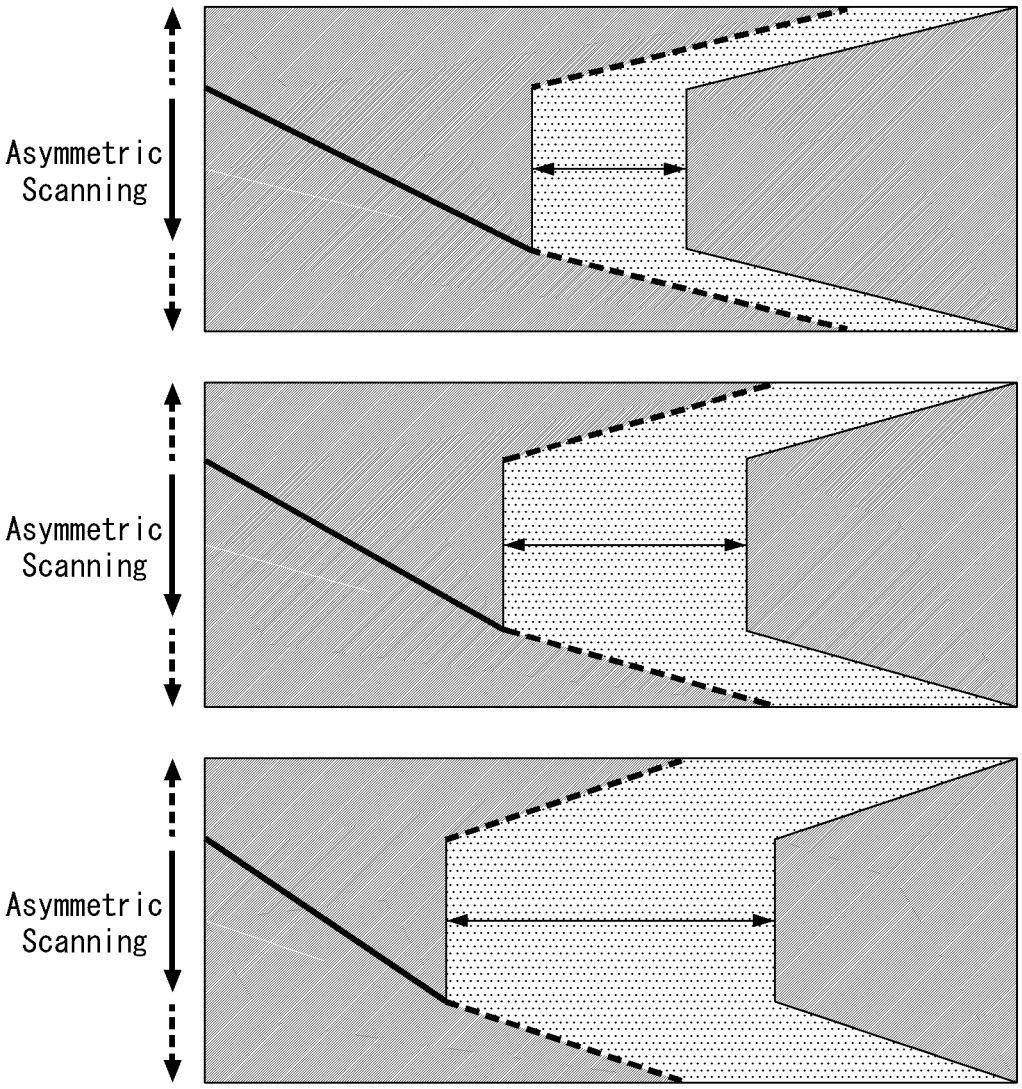

FIGS. 9A and 9B show embodiments in which an emission duration is increased by adjusting a scan speed. FIG. 9A is an embodiment in which the focus area is symmetrically scanned in the ping-pong addressing manner, and FIG. 9B is an embodiment in which the focus area is asymmetrically scanned in the sequential addressing manner.

In order to change the emission duration, the scan duration for performing the scan operation and the emission duration for performing the light emission operation may be relatively changed. The horizontal period 1H for applying data voltages to the pixels of one horizontal line may be changed and the number of horizontal periods to be allocated to the emission duration may be changed.

Since the number of horizontal periods allocated to the scan duration is fixed by the vertical resolution of the display panel (that is, the number of pixel lines), in order to change the number of horizontal periods allocated to the emission duration, the horizontal period 1H may be changed.

Therefore, it is possible to increase the emission duration by reducing the horizontal period 1H and allocating a large number of horizontal periods to the emission duration. If the horizontal period 1H is reduced, the scan speed increases (the slope of the straight line indicating the scan operation becomes steeper) and accordingly the start time of the light emission of the focus area is pulled out earlier and the light emission duration becomes longer.

In the focus area, FIG. 9A performs the scan operation symmetrically in the ping-pong addressing manner, while FIG. 9B performs the scan operation asymmetrically in the sequential addressing manner. However, in the peripheral area, the scan operation may be performed symmetrically with the ping-pong addressing method in both FIGS. 9A and 9B.

Figure 10A:
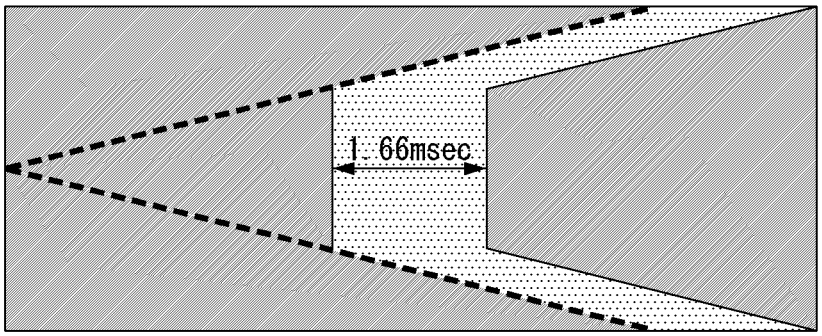
FIGS. 10A, 10B, and 10C illustrate an embodiment in which an emission duration is increased by fixing an emission start time and by controlling the scan speeds in the focus area and the peripheral area differently.
Figure 10B:
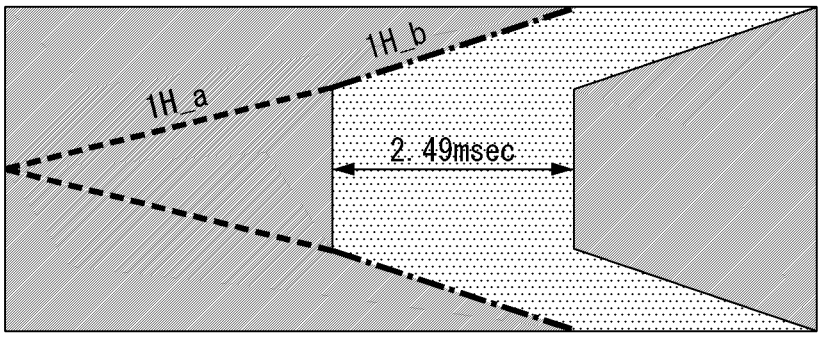
Figure 10C:
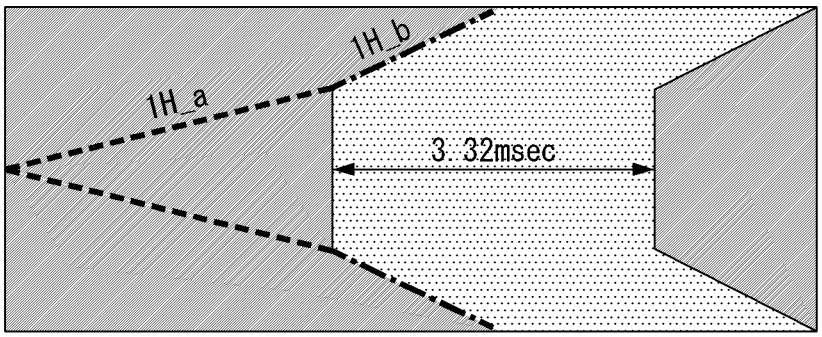

FIGS. 10A to 10C illustrates an embodiment in which an emission duration is increased by fixing an emission start time and by controlling the scan speeds in the focus area and the peripheral area differently.

In order to increase the emission duration in a state in which the light emission start time of the focus area is kept constant from the frame start time, the scan speed in the peripheral area may be increased without changing the scan speed in the focus area.

In FIG. 10A, when 4,800 pixel lines are driven at 120 Hz and a scan duration and an emission duration are set to 4:1, one horizontal period 1H is 1/120/6,000=1.39 usec, and the emission duration is 1H×1,200=1.66 msec.

In FIG. 10B, if the scan speed 1H_for scanning the focus area is maintained at 1.39 usec and the scan speed 1H_b for scanning the peripheral area is set to be 1.042 usec, that is, the scan speed (1H_b) for scanning the peripheral area is 1.042 usec, an average horizontal period becomes (⅖ *1H_a+⅗ *1H_b)=1.18 usec, and the emission duration can be increased to 2.49 msec. In an embodiment, ⅖ and ⅗ are the ratio of the focus area and the peripheral area in the display panel, indicating that the focus area is 40% and the peripheral area is 60%.

Similarly, in FIG. 10C, if the scan speed 1H_for scanning the focus area is maintained at 1.39 usec and the scan speed 1H_b for scanning the peripheral area is set to be 0.695 usec, an average horizontal period becomes (⅖ *1H_a+⅗ *1H_b) =0.97 usec, and the emission duration can be increased to 3.32 msec.

In the embodiment of FIGS. 10A to 10C, since both the focus area and the peripheral area are adjusted to have a same emission duration, the brightness may be uniform in both the focus area and the peripheral area, so that data need not be compensated.

Since the scan speeds of the focus area and the peripheral area are different, the host system may change the speed at which image data is transmitted, or the timing controller 11 may adjust the speed at which the image data is supplied by using a buffer.

And, since the operating frequencies of the data driving circuit 12 and the gate driving circuit 13 are changed when scanning the focus area and when scanning the peripheral area, the timing controller 11 may vary or alternately switch the frequencies of control signals and clock signals and supply them to the data driving circuit 12 and the gate driving circuit 13.

Figure 11A:
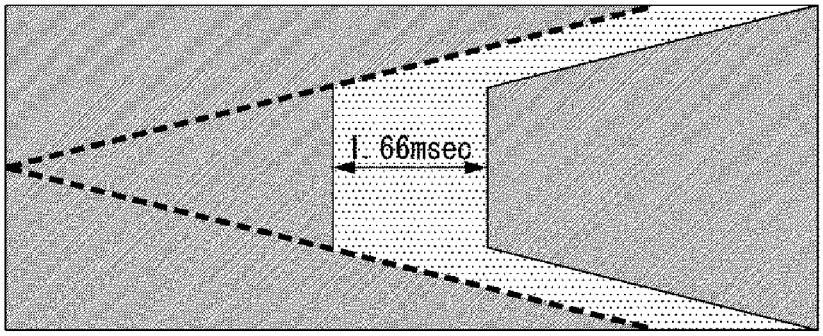
FIGS. 11A, 11B, and 11C show an embodiment in which an emission start time of the focus area is fixed, the scan speeds in the focus area and the peripheral area are made the same and an emission duration of only the focus area is increased.
Figure 11B:
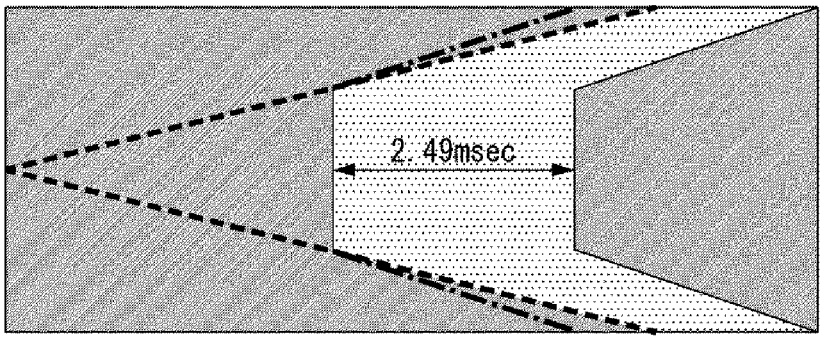
Figure 11C:
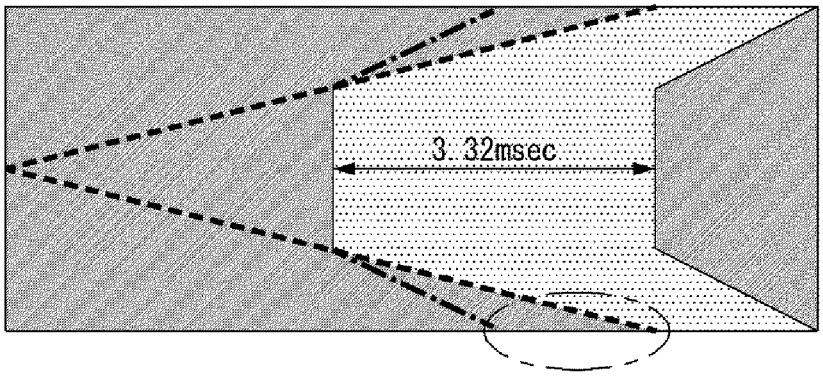

FIGS. 11A to 11C shows an embodiment in which an emission start time of the focus area is fixed, the scan speeds in the focus area and the peripheral area are made the same, and an emission duration of only the focus area is increased.

In FIGS. 11A to 11C, the emission durations differ between the focus area and the peripheral area, and the emission duration varies depending on the position in the peripheral area.

That is, to fix the emission start point and the scan speed of the focus area while increasing the luminance of the focus area, the emission duration of the focus area may be increased with a tradeoff in the emission duration of the peripheral area.

In order to finish the emission of the peripheral area within one frame while increasing the emission duration of the focus area to the same extent as shown in FIGS. 10B and 10C without changing the light emission start point and the scan speed of the focus area, the scan speed of the reset signal for sequentially stopping the light emission of the peripheral area should be faster than the scan speed for sequentially applying the data voltage to the peripheral area.

As the scan speed of the reset signal increases, the emission duration decreases and the luminance gradually decreases as a position (e.g., of a pixel) in the peripheral area is farther away from the center of the display panel. The luminance of the outer periphery decreases and the effect of focusing on the focus area located in the center occurs. However, since the luminance of the peripheral portion may become too lowered so as to be a problem, the deficient luminance of the peripheral area may be compensated by adjusting the gradation of the data supplied to the corresponding area upward. If there is no problem of gradual luminance reduction at the periphery of the peripheral area, there may be no problem without compensating the data.

In the embodiment of FIGS. 11A to 11C, since the reset driver that generates and outputs the reset signal makes the operating frequency at the time of initializing the pixel before writing data to the pixel and the operating frequency at the time of stopping the emission of the pixel be different from each other, the reset driver generates the reset signal while changing the control signal and the clock signal under the control of the timing controller 11.

Figure 12:
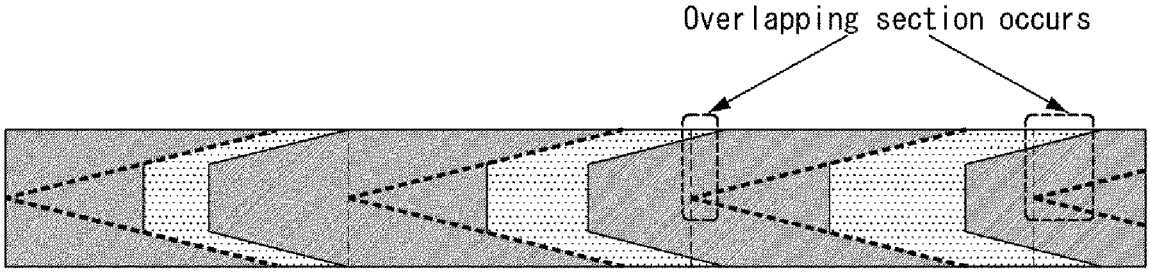
FIG. 12 shows an embodiment in which the emission duration of the focus area and the peripheral area are increased while the emission start time of the focus area is fixed and the scan speeds in the focus area and the peripheral area are equal to each other.
Figure 13A:
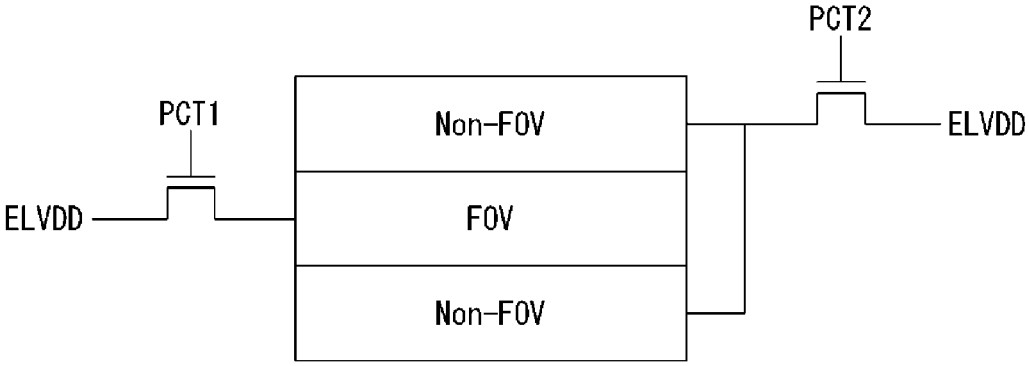
FIGS. 13A and 13B illustrate a power supply configuration and control signals for implementing the embodiment of FIG. 12.
Figure 13B:
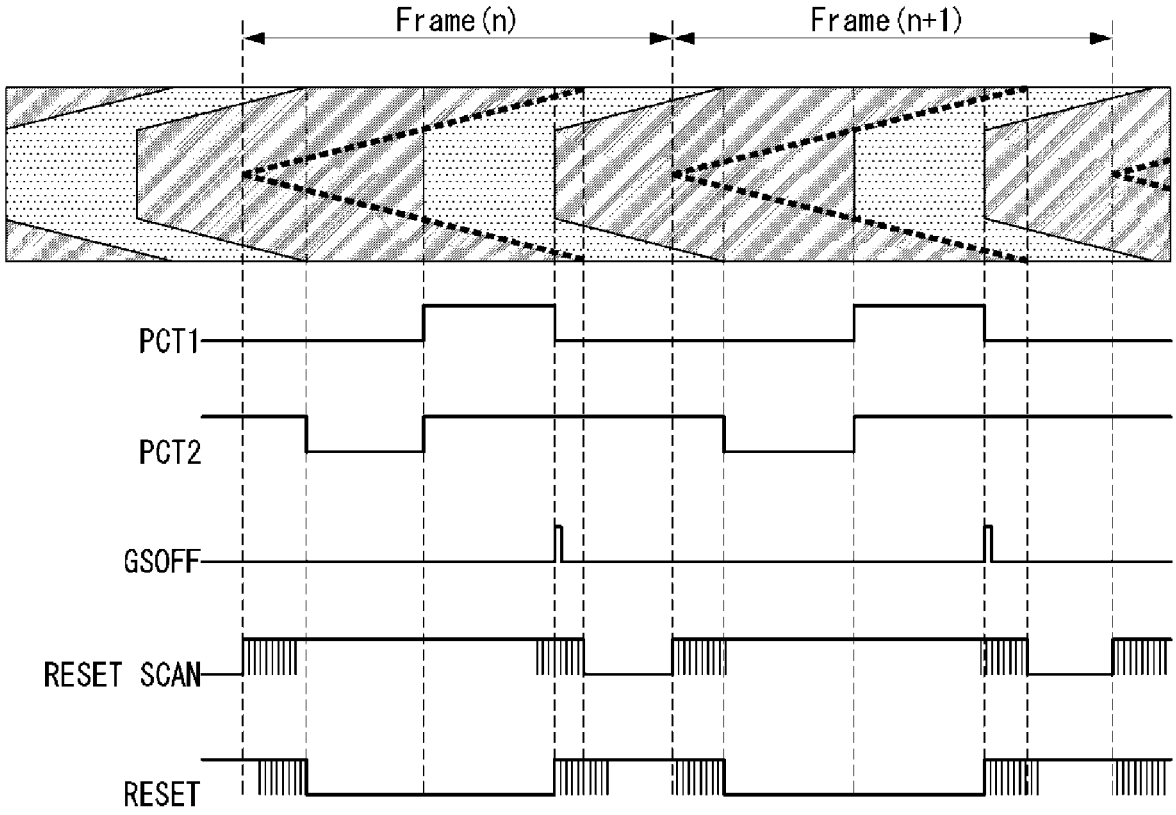

FIG. 12 shows an embodiment in which the emission duration of the focus area and the peripheral area are increased while the emission start time of the focus area is fixed and the scan speeds in the focus area and the peripheral area are equal to each other, and FIGS. 13A and 13B illustrate an example power supply configuration and control signals for implementing the embodiment of FIG. 12.

Also in FIG. 12, by setting the scan speed to be same in the focus area and the peripheral area, and by increasing the emission duration while fixing the light emission start point of the focus area, the luminance of the focus area and the peripheral area may be increased together.

However, the embodiment of FIG. 12 differs from the embodiment of FIGS. 11A to 11C in that the scan rate of the reset signal which sequentially stops the emission of the peripheral area is same as the scan rate at which data voltages are sequentially applied to the peripheral area. Thus, the emission durations of the focus area and the peripheral area become equal to each other, but the scan speed of the reset signal for stopping the light emission becomes slower than that in the embodiment of FIGS. 11A to 11C, so that the point of stopping the light emission at the periphery of the peripheral area passes over the boundary of a current frame to a next frame.

As described with reference to FIG. 5A, in case of adjusting the light emission start point of the pixel to which data is written by controlling supply of the high potential power voltage ELVDD to the driving transistor DT of the pixel through the power control transistor PCT, the light emission of the peripheral area and the data writing of the focus area overlap each other, so the focus area in which data is written may be emitted beforehand or the light emission of the peripheral area may be stopped before the emission duration is completed depending on whether the high potential power voltage ELVDD has been supplied.

In order to solve such a problem, as shown in FIGS. 13A and 13B, the high potential power voltage ELVDD may be separately supplied to the focus area and the peripheral area.

In FIGS. 13A and 13B, the pixels of the focus area (FOV area) are controlled to supply the high potential power voltage ELVDD through a first power control transistor PCT1, and the pixels of the non-FOV area are controlled to supply the high potential power voltage ELVDD through a second power control transistor PCT2.

The first power control transistor PCT1 may be turned on when the scan operation of the focus area is completed to supply the high potential power voltage ELVDD to the pixels in the focus area and thus simultaneously emit the focus area. The first power control transistor PCT1 may be turned off in synchronization with the global shutter off signal GSOFF to interrupt the supply of the high potential power voltage ELVDD and thus stop the light emission.

Since the focus area is simultaneously reset and the light emission of the focus area is stopped if the reset signal is applied to the focus area in synchronization with the global shutter-off signal GSOFF, the first power control transistor PCT1 may be turned off at the end of the current frame.

The second power control transistor PCT2 may be turned on when the scan operation of the focus area is completed and supply the high potential power voltage ELVDD to the pixels in the peripheral area to sequentially emit the pixels in the peripheral area. And, the second power control transistor PCT2 may be turned off when the reset signal for stopping the light emission is applied to the outermost pixel line of the peripheral area and interrupt the supply of the high potential power voltage ELVDD to stop the light emission. Since the peripheral area operates in the rolling shutter method, the high potential power voltage ELVDD may be supplied to the pixels in the peripheral area without the second power control transistor PCT2.

Figure 14A:
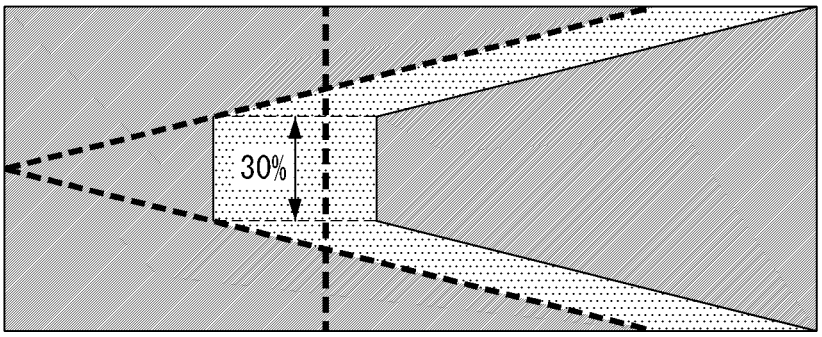
FIGS. 14A, 14B, and 14C illustrate an embodiment in which the size of the focus area is adjusted by adjusting the scan start time and the emission start point of the focus area.
Figure 14B:
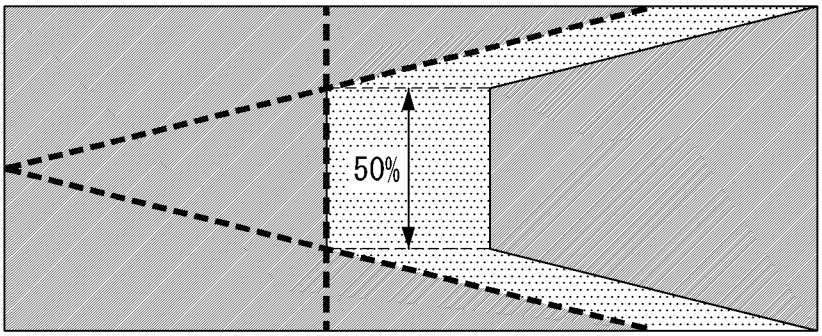
Figure 14C:
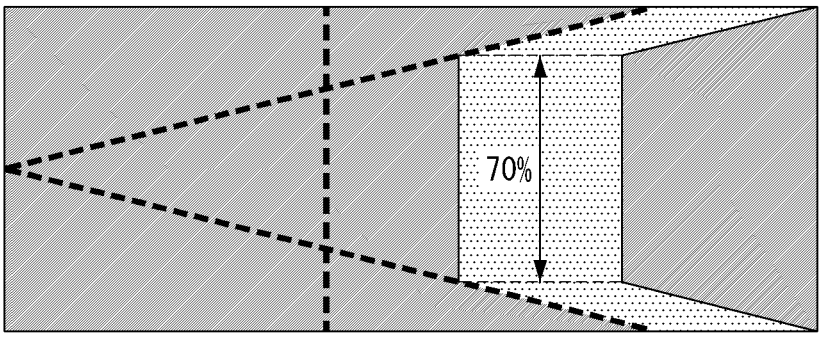
Figure 15A:
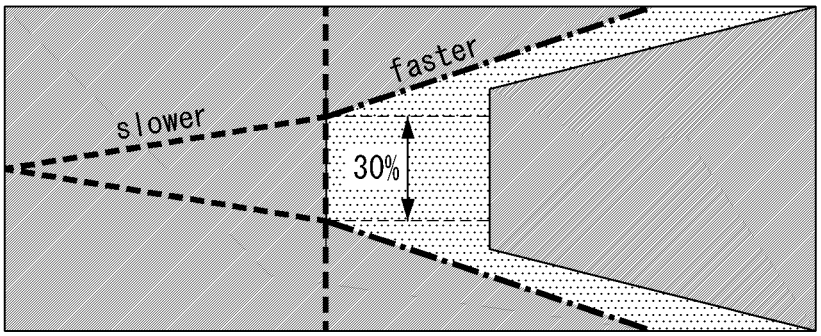
FIGS. 15A, 15B, and 15C illustrate an embodiment of adjusting the size of the focus area by fixing the emission start point of the focus area and adjusting the scan speeds of the focus area and the peripheral area.
Figure 15B:
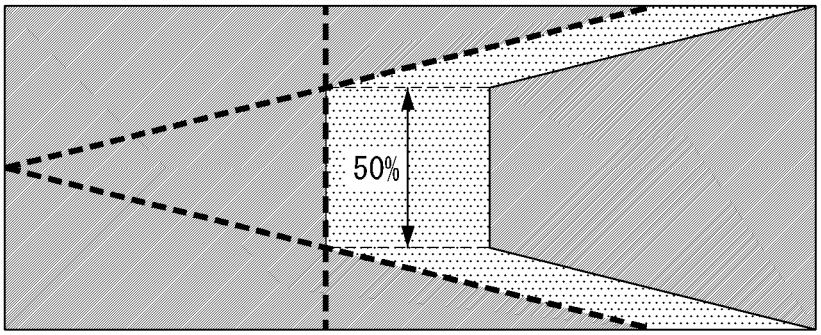
Figure 15C:
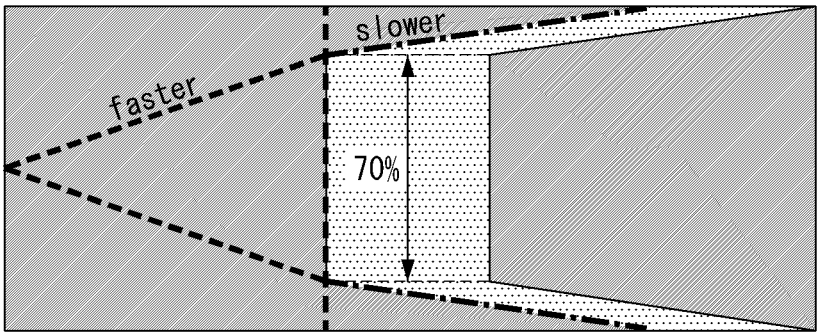

FIGS. 14A to 14C illustrate an embodiment in which the size of the focus area is adjusted by adjusting the scan start time and the emission start point of the focus area, and FIGS. 15A to 15C illustrates an embodiment of adjusting the size of the focus area by fixing the emission start point of the focus area and adjusting the scan speeds of the focus area and the peripheral area.

As shown in FIGS. 14A to 14C, when the vertical width of the focus area is changed, the light emission start point of the focus area may be adjusted back and forth without changing the scan speed in the focus area and the peripheral area. In order to reduce the vertical width of the focus area, the light emission start point of the focus area may be pulled forward. In order to increase the vertical width of the focus area, the light emission start point of the focus area may be delayed backward.

Alternatively, as shown in FIG. 15A to 15C, while fixing the emission start point of the focus area, the vertical width of the focus area may be reduced by making the scan speed of the focus area slower than the scan speed of the peripheral area, and the vertical width of the focus area may be increased by making the scan speed of the focus area faster than the scan speed of the peripheral area.

Figure 16A:
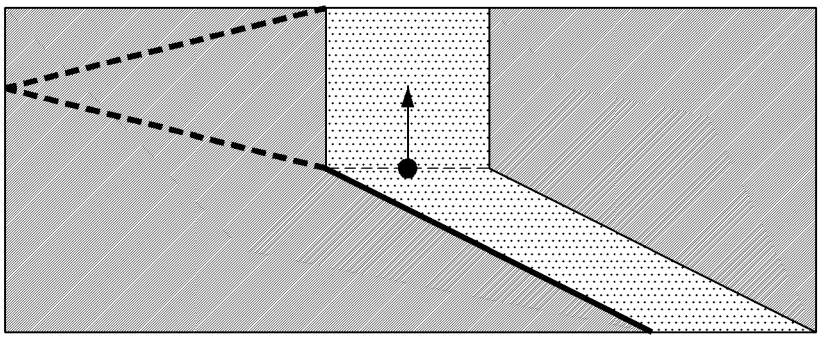
FIGS. 16A, 16B, and 16C show an embodiment for changing the position of the focus area.
Figure 16B:
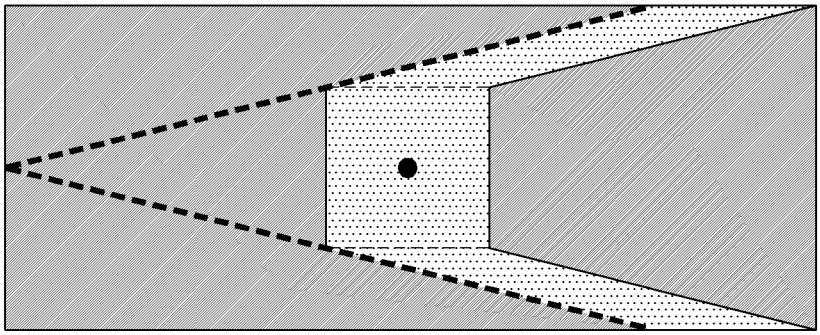
Figure 16C:
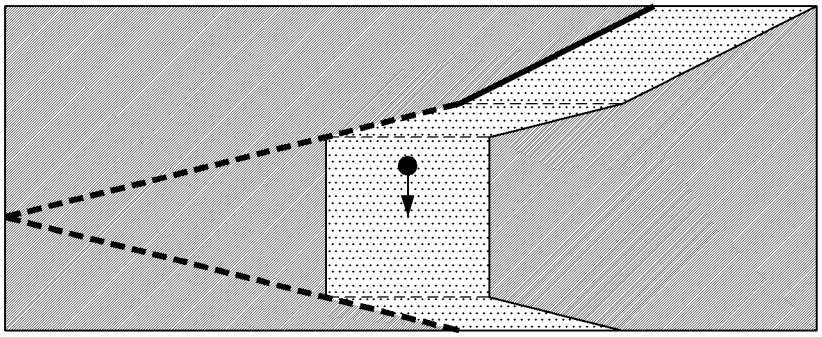

FIGS. 16A to 16C show an embodiment for changing the position of the focus area. In FIGS. 16A to 16C, the scan speed and the light emission start point of the focus area are fixed.

The focus area may move upward or downward from the screen center of the display panel, but the scan method may change depending on the movement degree of the focus area.

As shown in FIG. 16A, when the focus area is located at the uppermost edge of the screen, the scan operation in the focus area may be performed in the ping-pong addressing manner and the scan operation in the peripheral area may be performed in the sequential addressing manner. Or, the scan operation in the focus area may be performed in the sequential addressing manner.

As shown in FIG. 16C, the focus area does not touch the uppermost or lowermost edge of the screen, the scan operation in the focus area may be performed in the ping-pong addressing manner, and the scan operation may be performed in the sequential scanning manner in the direction toward the wider area of the peripheral area after the scan operation is performed in the ping-pong addressing manner until the scan is completed in the direction toward the narrower area of the peripheral area. Or the scan operation may be performed from a first boundary of the peripheral area to a second doubdary of the peripheral area in a direction in which the data lines travel.

By combining the embodiment of FIGS. 16A to 16C with the embodiment of FIGS. 10A to 10C, the emission duration may be adjusted while changing the position of the focus area by changing the scan speed in the focus area and the scan speed in the peripheral area.

On the other hand, the emission duration may be applied to each frame differently. By applying one of the embodiments of FIGS. 10A to 10C, 11A to 11C, and 12, or a combination thereof, the emission duration may be different for each frame.

In addition, one of the embodiments of FIGS. 14A to 14C and 15A to 15C or a combination thereof may be applied to each frame to adjust the size of the focus area differently for each frame.

Further, the embodiment of FIGS. 16A to 16C may be applied to each frame to change the position of the focus area differently for each frame.

Figure 17:
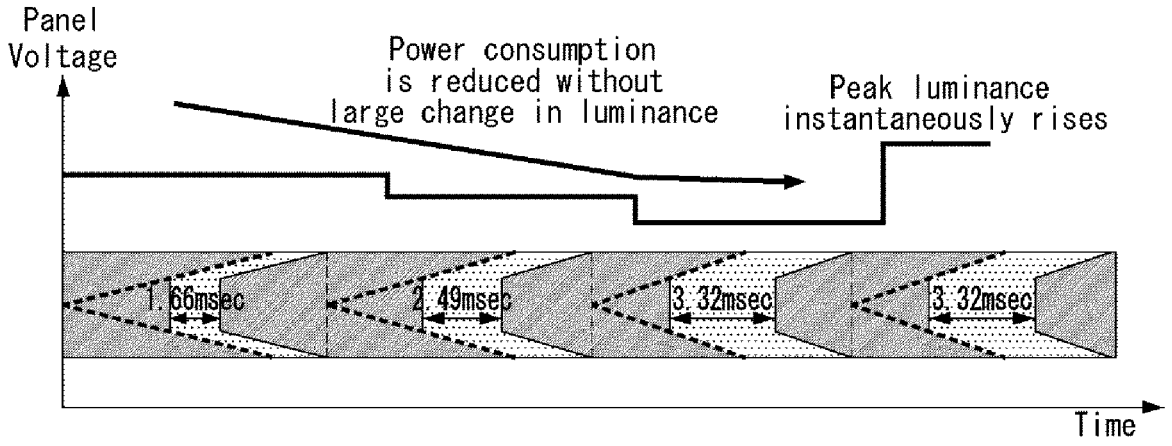
FIG. 17 illustrates an embodiment in which power consumption is reduced by adjusting the level of the power supply voltage applied to the panel and the emission duration of the focus area.

FIG. 17 illustrates an embodiment in which power consumption is reduced by adjusting the level of the power supply voltage applied to the panel and the emission duration of the focus area.

While adjusting the emission duration differently for each frame by applying one of the embodiments of FIGS. 9A through 12 or a combination thereof to each frame, the magnitude of the power supply voltage supplied to the display panel may be changed correspondingly, thereby reducing power consumption.

In FIG. 17, the emission duration is increased as frames progress by increasing the scan speed and pulling the emission start point forward as the embodiment of FIG. 10. By decreasing the level of the power supply voltage supplied to the display panel in proportion to the increase of the emission duration, the power consumption may be reduced without a large change in luminance.

Further, in an embodiment, by raising the luminance instantaneously in the frame while raising the power supply voltage supplied to the display panel in the fourth frame in FIG. 17, in a state in which the emission duration is increased, it is possible to enhance the dramatic effect of the VR application and improve the dynamic characteristic.

Meanwhile, in case of changing the position and size of the focus area and in case of changing the light emission start point of the focus area for each frame, since the scan signal and the reset signal for implementing the cases are continuously changed, it may not be easy to configure the gate driving circuit as a physical circuit. In these cases, the gate driving circuit may be implemented as a decoder type. Output ports corresponding to the number of horizontal lines (N), which is the vertical resolution of the display panel, are equipped in the gate driving circuit of the decoder type, and the scan signals and the reset signals may be output through the output ports with input codes greater than log 2N.

As described above, the VR sickness due to the VR driving may be reduced by making the focus area in which the user's gaze stays simultaneously emit light and making the peripheral area sequentially emit light. It is possible to improve the deficient brightness of the panel due to the high resolution by varying the emission duration. The dynamic characteristics may be improved by varying the luminance differently for each frame depending on the contents.

Throughout the description, it should be understood by those skilled in the art that various changes and modifications are possible without departing from the technical principles of the present disclosure. Therefore, the technical scope of the present disclosure is not limited to the detailed descriptions in this specification but should be defined by the scope of the appended claims.

What is claimed is:

1. A display panel, comprising:

a display panel having a display area and including data lines and scan lines crossing each other and pixels disposed in a plurality of horizontal lines;

a data driving circuit configured to supply data voltages to the data lines;

a gate driving circuit configured to supply scan signals for applying the data voltages to the pixels and to supply reset signals for turning off the pixels that are emitting light to the pixels through the scan lines;

a timing controller configured to cause first pixels in a first area to simultaneously emit light and simultaneously stop emitting light, and cause second pixels in a second area different than the first area to sequentially emit light and sequentially stop emitting light by controlling the data driving circuit and the gate driving circuit, wherein the first area includes a central portion in the display area, and the second area includes a peripheral area except for the central portion in the display area; and a power control transistor disposed between the pixels and a power line, wherein the timing controller is configured to turn off the power control transistor while addressing data to the first pixels and turn on the power control transistor when the addressing data to the first pixels is completed.

2. The display device of claim 1, wherein the timing controller is configured to cause the first pixels to simultaneously emit light after applying the data voltages to all the first pixels, and to cause the second pixels to sequentially emit light while sequentially applying the data voltages to the second pixels.

3. The display device of claim 2, wherein the timing controller is configured to cause the first pixels to simultaneously stop emitting light after an emission duration elapses since the first pixels simultaneously emit light, and to cause the second pixels to sequentially stop emitting light after the emission duration elapses since the second pixels sequentially emit light in a unit of the plurality of horizontal lines.

4. The display device of claim 1, wherein the first area is disposed at a center of the display panel with respect to a first direction in which the data lines travel, wherein the second area is divided into third and fourth areas on upper and lower sides, respectively, of the first area with respect to the first direction, and wherein the timing controller is configured to alternately perform a first scan operation in the third area and a second scan operation in the fourth area at an interval of one horizontal period in a ping-pong addressing manner.

5. The display device of claim 4, wherein the timing controller is configured to alternately perform an upward scan operation and a downward scan operation at the interval of one horizontal period in the ping-pong addressing manner, the upward scan operation proceeding from a center of the first area toward the third area with respect to the first direction, the downward scan operation proceeding from the center of the first area toward the fourth area with respect to the first direction, or wherein the timing controller is configured to perform a scan operation from a first boundary of the first area toward a second boundary of the first area with respect to the first direction in a sequential addressing manner.

6. The display device of claim 1, wherein the first area is disposed at a center of the display panel with respect to a first direction in which the data lines travel, wherein the second area is divided into a third area and a fourth area on one side and an opposite side, respectively, of the first area with respect to the first direction, and wherein the timing controller is configured to perform a scan operation for the third area in a sequential addressing manner after performing another scan operation from a boundary of the first area and the third area toward the fourth area in the sequential addressing manner.

7. The display device of claim 1, wherein the first area is disposed at one end of the display panel with respect to a first direction in which the data lines travel, and wherein the timing controller is configured to perform a scan operation in a direction from the first area toward the second area in a sequential addressing manner.

8. The display device of claim 1, wherein the timing controller is configured to adjust an emission duration by varying a first scan speed at which the data voltages are applied to the first pixels in the first area and a second scan speed at which the data voltages are applied to the second pixels in the second area, the first scan speed equal to the second scan speed, the emission duration being a time interval from a point at which the pixels are turned on to a point at which the pixels are turned off.

9. The display device of claim 8, wherein the timing controller is configured to make the emission duration in the second area gradually decrease as a distance from the first area increases by making a third scan speed of the reset signals for turning off the second pixels in the second area be higher than the second scan speed.

10. The display device of claim 9, wherein the timing controller is configured to adjust data gradation corresponding to the data voltages applied to the second pixels in the second area upward as the distance from the first area increases.

11. The display device of claim 1, wherein the timing controller is configured to adjust an emission duration from a point at which the pixels are turned on to a point at which the pixels are turned off, by varying a first scan speed at which the data voltages are supplied to the first pixels in the first area to be different from a second scan speed at which the data voltages are supplied to the second pixels in the second area.

12. The display device of claim 1, wherein when changing a width of the first area with respect to a first direction in which the data lines travel, the timing controller is configured to adjust a light emission start point at which the first pixels are simultaneously turned on back and forth by using a first scan speed at which the data voltages are applied to the first pixels in the first area and a second scan speed at which the data voltages are applied to the second pixels in the second area equal to the first scan speed, or varying the first scan speed and the second scan speed while fixing the light emission start point.

13. The display device of claim 1, wherein the timing controller is configured to lower a power supply voltage supplied to the pixels by controlling a power generator responsive to increasing an emission duration from a point at which the pixels are turned on to a point at which the pixels are turned off.

14. The display device of claim 1, wherein each of the pixels comprises:

a light emitting element, a driving transistor for controlling a driving current through the light emitting element according to a gate-source voltage, a first transistor for connecting the data line and a gate electrode of the driving transistor according to the scan signals, a capacitor for storing the data voltages applied through the data line, and a second transistor for initializing the driving transistor and the light emitting element and turning off the light emitting element according to the reset signals.

15. The display device of claim 14, wherein the gate driving circuit is configured to simultaneously supply the reset signals to the first pixels after an emission duration elapses since the first pixels are simultaneously turned on, and to sequentially supply the reset signals to the second pixels in a unit of the plurality of horizontal lines after simultaneously supplying the reset signals.

16. The display device of claim 1, wherein the timing controller is configured to control a power generator not to supply a power supply voltage to the first pixels during applying the data voltages to the first pixels.

17. The display device of claim 1, wherein the first area and the second area are electrically disconnected from each other, and wherein the timing controller is configured to supply a power supply voltage to the first pixels during an emission duration of the first pixels and supply the power supply voltage to the second pixels during a period of time in which the data voltages are applied to the second pixels and another emission duration of the second pixels.

18. The display device of claim 1, wherein the timing controller is configured to cause the first pixels in the first area to simultaneously emit light and then simultaneously stop emitting light during one frame period.

* * * * *